US007618039B2

(12) United States Patent
Mandai et al.

(10) Patent No.: US 7,618,039 B2
(45) Date of Patent: Nov. 17, 2009

(54) SHEET DETECTING APPARATUS AND IMAGE FORMING APPARATUS

(75) Inventors: Hidenobu Mandai, Nara (JP); Masaru Tsuji, Nara (JP); Osamu Fujimoto, Nara (JP); Masaki Saka, Mie (JP)

(73) Assignee: Sharp Kabushiki Kaisha, Osaka (JP)

( * ) Notice: Subject to any disclaimer, the term of this patent is extended or adjusted under 35 U.S.C. 154(b) by 164 days.

(21) Appl. No.: 10/965,725

(22) Filed: Oct. 18, 2004

(65) Prior Publication Data

US 2005/0104282 A1 May 19, 2005

(30) Foreign Application Priority Data

Oct. 31, 2003 (JP) ..... 2003-372778

(51) Int. Cl.
*B65H 7/02* (2006.01)

(52) U.S. Cl. ..... 271/227; 271/258.01; 271/265.01; 250/559.36

(58) Field of Classification Search ..... 271/227, 271/242, 258.01, 259, 265.01, 265.02, 265.03, 271/621; 250/221, 208.1, 216, 559.12–559.15, 250/559.36

See application file for complete search history.

(56) References Cited

U.S. PATENT DOCUMENTS 3,591,801 A * 7/1971 Watson ..... 250/373
4,498,767 A * 2/1985 McGovern et al. ..... 356/121
5,075,558 A * 12/1991 Nakagawa ..... 250/556
5,136,150 A * 8/1992 Fukushima et al. ..... 250/208.1
5,266,812 A * 11/1993 Mokuo ..... 250/559.4
5,516,094 A * 5/1996 Sander ..... 271/259
5,681,036 A * 10/1997 Wakahara et al. ..... 271/10.12
5,726,443 A * 3/1998 Immega et al. ..... 250/227.2
5,918,877 A * 7/1999 Takei et al. ..... 271/261
2002/0043633 A1* 4/2002 Jackson et al. ..... 250/559.36
2003/0116725 A1* 6/2003 Sorebo et al. ..... 250/559.36
2003/0146566 A1* 8/2003 Aizawa ..... 271/242
2005/0002105 A1* 1/2005 Nemoto et al. ..... 359/619
2005/0072904 A1* 4/2005 Aykac et al. ..... 250/208.1
2006/0071393 A1* 4/2006 Mizubata et al. ..... 271/10.01

FOREIGN PATENT DOCUMENTS

JP 10-186951 A 7/1998

* cited by examiner

*Primary Examiner*—Patrick H Mackey
*Assistant Examiner*—Jeremy Severson
(74) *Attorney, Agent, or Firm*—Birch, Stewart, Kolasch & Birch LLP

(57) ABSTRACT

In a sheet detecting sensor, light emitted from a linear light emitting element is blocked by a sheet from entering a light receiving element which is located immediately below the sheet. Only light receiving elements which are not immediately below the sheet, receive light from the linear light emitting element. Light passing through a point in a vicinity of an edge portion of the sheet enters only a light receiving element which is located immediately below that point, but not the other light receiving elements. In addition, even when the position of a sheet varies vertically, the same light receiving element receives light passing through the same point in a vicinity of the edge portion of the sheet. Therefore, even when the position of a sheet varies vertically, the edge position of the sheet can be accurately detected.

7 Claims, 16 Drawing Sheets

SHEET DETECTING APPARATUS AND IMAGE FORMING APPARATUS

BACKGROUND OF THE INVENTION

This application claims priority under 35 U.S.C. §119(a) on Patent Application No. 2003-372778 filed in Japan on Oct. 31, 2003, the entire contents of which are hereby incorporated by reference.

The present invention relates to a sheet detecting apparatus for detecting a transport state of a sheet, which is provided in an image forming apparatus, and an image forming apparatus using the same.

Generally, in such an image forming apparatus, an electrostatic latent image is formed on an image carrier based on input image data, and the electrostatic latent image is developed by an development apparatus to form a development-agent image on the image carrier. The development-agent image formed on the image carrier is transferred to a transported sheet. Thereafter, the development-agent image is melted and fixed by heat and pressure onto the sheet using a fixation device.

When a positional displacement occurs between the development-agent image formed on the image carrier and the transported sheet due to the transport skew of the sheet, the position of the formed image differs from the position of a read original image. Such a positional displacement due to the transport skew of a sheet is usually inconsistent and also varies depending on a difference in the size or type of sheets or an accommodation means for accommodating sheets.

Therefore, when trying to form an image g on an entire sheet p with no margin (entire sheet image formation) as shown in FIG. 16, a positional displacement between a development-agent image and the sheet p would cause loss of a portion of the image g transferred to the sheet p, resulting in an unsightly image product.

To avoid this, taking into consideration the positional displacement between a development-agent image on an image carrier and a sheet due to the transport skew of the sheet, an oversized image (development-agent image) g is formed on an image carrier as shown in FIG. 17. In this case, even when the fed sheet p is skewed, a satisfactory image can be formed without any portion of the sheet p lacking the image.

In the above-described case, however, when an image having a size which significantly exceeds a transported sheet is formed on an image carrier, a large amount of development agent which has not been transferred onto the sheet is recovered by a cleaning means. In the case of an image forming apparatus which cannot reuse the recovered development agent, the recovered development agent is discarded, resulting in uneconomical use of the development agent. In addition, a container for recovery of a development agent is filled very quickly with the recovered development agent.

FIG. 18 shows a cleaning means c integrated with a container a for recovering a development agent t from a transfer belt d which is used to attach to and transport a sheet p. In this cleaning means, a greater amount of accumulation of the recovered development agent t tends to occur at sites located on the right- and left-hand sides of the sheet p in a sheet transport direction. Such accumulated development agent t is likely to partially leak, leading to cleaning failure.

To avoid this, conventionally, a means for detecting an edge position of a sheet transported toward a transfer point where an image formed on an image carrier is transferred to the sheet, is provided upstream, in the sheet transport direction, from the transfer point. A size of the sheet is detected at the edge portion by the detection means. Based on the sheet size, a size of an image to be formed on the image carrier is determined. After size determination, the image is formed on the carrier, and is then transferred to the sheet. Thus, an image having a size, which matches the size of a transported sheet, is formed on an image carrier, thereby reducing the amount of a development agent which is not transferred to the sheet and is recovered by a cleaning means. See, for example, JP 10-186951A.

In the above-described conventional technique, the image is formed on the image carrier after the sheet edge position is detected by the detection means and the size of an image to be formed on an image carrier is then determined. Therefore, the detection means needs to be placed considerably upstream, in the sheet transport direction, from the transfer point. In other words, a relatively long sheet transport path is required, which extends in the sheet transport direction from a point of detecting the edge position of a sheet by the detection means to the transfer point. Therefore, the size of the image forming apparatus becomes very large. Moreover, as the sheet transport path from the detection point of the detection means to the transfer point is increased, the time required to form an image increases accordingly.

Furthermore, as the sheet transport path from the detection point of the detection means to the transfer point is increased, the accuracy of detecting the edge position of a sheet by the detection-means is decreased. Therefore, in this case, there is the risk that a portion of an image is lost on the sheet due to the transport skew of the sheet. Conversely, when the detection means is placed closer to the transfer point, writing of an image onto an image carrier is started before detecting the edge position of a sheet. Therefore, the determination of an image size on the carrier is too late for the writing of the image.

Furthermore, a registration means (timing adjusting means) for adjusting the position of the image formed on the image carrier in relation to a transported sheet, is provided upstream, in the sheet transport direction, from the image carrier. The registration means abuts a leading edge of a transported sheet to temporarily stop the sheet. Subsequently, the registration means restarts transporting the sheet with appropriate timing. The registration means has not only the function of deciding on the timing of registering a sheet in relation to the image on the image carrier, but also a function of correcting the skew (oblique feeding) of the transported sheet.

In this case, when the detection means is placed upstream, in the sheet transport direction, from the registration means, it can be ensured that the distance of the sheet transport path from the detection point of the detection means to the transfer point does not become any longer. However, the correction of the transport skew by the registration means is not yet performed at the detection point which is located upstream, in the sheet transport direction, from the registration means. Therefore, the accuracy of detecting the edge position of a sheet by the detection means cannot be improved.

The inventors of the present application have already filed an application (Japanese Patent Application No. 2003-169429) which is directed to a technique, in which a registration means is placed upstream, in the sheet transport direction, from a detection means. In this technique, after the transport skew of a sheet is corrected, the edge position of the sheet is detected, so that the accuracy of detecting the edge position of the sheet is assured.

However, in some cases, the vertical position of a sheet is not specified upstream, in the sheet transport direction, from the registration means, resulting in a reduction in the accuracy of detecting the edge position of the sheet. For example, the vertical position of a sheet cannot be specified at a site where a plurality of transport paths (upper transport path(s) and lower transport path(s)) are merged, the site being located upstream, in the sheet transport direction, from the registration means.

FIG. 19 shows sheets p1, p2 and p3 of the same size, which are positioned at different heights, and a light emitting element h and light receiving elements i, which are used to detect the edge position of the sheet. As can be clearly seen from FIG. 19, light emitted by the light emitting element h falls on a light receiving element i which is located on a right-hand side with respect to the edge of the sheet, no matter whether the sheet to be detected is p1, p2 or p3. The position of a rightmost light receiving element i, which receives incident light from the light emitting element h, varies depending on which sheet is detected, p1, p2 or p3. Therefore, the accuracy of detecting the edge position of the sheet is poor.

FIG. 20 shows that a rod lens array j is interposed between the transported sheet and the light receiving elements i. In this case, as in FIG. 19, the position of the rightmost light receiving element i that receives incident light from the light emitting element h varies depending on which sheet is detected, p1, p2 or p3. Therefore, the accuracy of detecting the edge position of a sheet is poor.

It is thus an object of the present invention to provide a sheet detecting apparatus capable of assuring the accuracy of detecting the edge position of a sheet, even when the vertical position of a sheet is not specified; and an image forming apparatus with the same.

SUMMARY OF THE INVENTION

In order to achieve the above-described object, a sheet detecting apparatus according to the present invention for use in an image forming apparatus is provided, in which the image forming apparatus forms an image on an image carrier based on input image data and transfers the image onto a transported sheet to form an image on the sheet, and the sheet detecting apparatus is used for detecting a transport state of the sheet before the image is transferred to the sheet. The sheet detecting apparatus comprises: a light emitting section for irradiating a sheet transport path with light; a plurality of light receiving sections for receiving the light from the light emitting section via the sheet transport path, in which the plurality of light receiving sections are arranged in a line along a direction perpendicular to a sheet transport direction; and a hood means for causing the light from the light emitting section to enter each light receiving section in a substantially straight direction via respective locations on the transport path.

According to the present invention, the hood means causes light from a light emitting section to enter each light receiving section in a substantially straight direction via respective locations on a transport path. Therefore, light passing through a point in a vicinity of an edge portion of a transported sheet enters one of the light receiving sections in a substantially straight direction. Even when the position of a sheet varies vertically, the same light receiving section receives light passing through the same point in a vicinity of the edge portion of the sheet. Therefore, even when the vertical position of a sheet is not specified, the accuracy of detection of the edge position of a sheet can be assured.

Further, in the above-described configuration, the hood means may have a plurality of opening portions, arranged in a line along the direction perpendicular to the sheet transport direction and guiding the light entering via the transport path from the light emitting section to the respective light receiving sections. Note that the light receiving sections and the opening portions may not have a one-to-one correspondence. For example, two light receiving sections can be provided for each opening portion.

Furthermore, in the above-described configuration, the opening portion of the hood means may absorb light with at least an inner wall surface thereof.

In this case, light is absorbed by the inner wall surface of the opening portion of the hood means. Therefore, light obliquely entering the opening portion is absorbed by the inner wall surface, so that only light entering in a straight direction falls on the light receiving section.

An image forming apparatus according to the present invention comprises the above-described sheet detecting apparatus. Therefore, the image forming apparatus of the present invention can achieve the same functions and effects as those of the sheet detecting apparatus of the present invention.

In the above-described configuration, the sheet detecting apparatus may be provided upstream of a registration means for temporarily stopping a sheet partway during transportation and correcting a transport skew of the sheet.

In this case, the sheet detecting apparatus is provided upstream of the registration means. The registration means temporarily stops a sheet partway during transportation and corrects a transport skew of the sheet. Therefore, the sheet detecting apparatus detects an edge position of a sheet, whose transport skew has been corrected, thereby making it possible to assure the detection accuracy.

Further, in the above-described configuration, the sheet detecting apparatus may be provided at a site where a plurality of transport paths for transporting a sheet are merged.

In this case, even when the vertical position of a sheet is not specified, the accuracy of detecting an edge position of a sheet is assured. Therefore, the sheet detecting apparatus of the present invention is useful.

DESCRIPTION OF THE PREFERRED EMBODIMENTS

Hereinafter, the present invention will be described by way of examples with reference to the accompanying drawings.

Example 1

Figure 1:
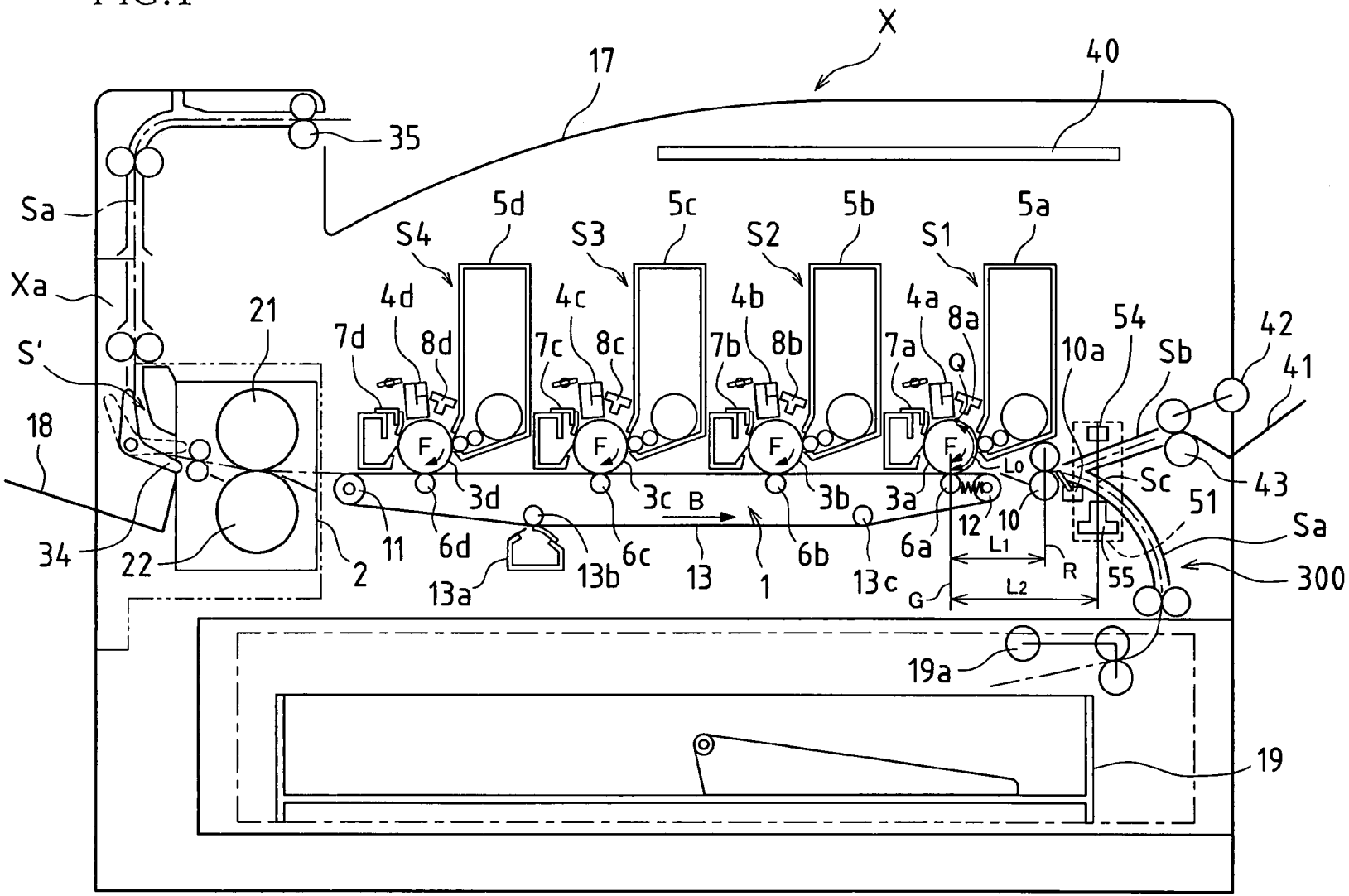
FIG. 1 is a diagram schematically showing a configuration of an electrophotographic image forming apparatus according to Example 1 of the present invention.

FIG. 1 shows a major portion of an electrophotographic image forming apparatus X according to Example 1 of the present invention. The image forming apparatus X comprises a transfer/transport belt mechanism 1. The transfer/transport belt mechanism 1 comprises a drive roller 11 which is rotatably supported at one end (left-hand side in FIG. 1) thereof, a slave roller 12 which is rotatably supported at the other end (right-hand side in FIG. 1) thereof, and an endless transfer/transport belt 13 which is tightly looped over the rollers 11 and 12 and is driven as a sheet carrier in a direction indicated by arrow B in FIG. 1. A sheet of recording paper P (see FIG. 2) is attached with static electricity to a surface of the transfer/transport belt 13, so that the recording paper P supplied through registration rollers 10, 10 (registration means) is transported from the other end (upstream side) to the one end (downstream side). The registration rollers 10, 10 are also used to temporarily stop the transported recording paper P. The registration rollers 10, 10 have a function of transporting the recording paper P with appropriate timing that is properly coordinated with the rotation of photoconductive drums 3*a* to 3*d* so that toner images on the photoconductive drums 3*a* to 3*d* are satisfactorily transferred to and superposed together on the recording paper P. Specifically, the registration rollers 10, 10 are designed to transport the recording paper P in a manner which registers a leading edge of a print range of the recording paper P to a leading edge of the toner image of each of the photoconductive drums 3*a* to 3*d*, based on a detection signal that is output by a registration sensor 10*a*. Here, the transfer/transport belt 13 is made of endless film having a thickness of about 100 μm to about 150 μm.

A fixation device 2 is provided downstream (left-hand side in FIG. 1), in a recording paper P transport direction, from the transfer/transport belt mechanism 1. The fixation device 2 is used to fix the toner images, which have been transferred to the recording paper P, onto the recording paper P. The fixation device 2 comprises a heat roller 21 and a pressure roller 22, which are arranged vertically. The front and rear surfaces of the recording paper P, which has been transported on the transfer/transport belt mechanism 1 (transfer/transport belt 13), are passed through a nip between the heat roller 21 and the pressure roller 22.

A first image forming station S1, a second image forming station S2, a third image forming station S3, and a fourth image forming station S4 are provided above the transfer/transport belt mechanism 1. These stations are located close to the transfer/transport belt 13 and are lined up in predetermined intervals from upstream (right-hand side in FIG. 1) in the recording paper transport path. In this case, the recording paper P is transported on the transfer/transport belt 13 in this sequence from the first image forming station S1 to the second image forming station S2 to the third image forming station S3 to the fourth image forming station S4.

The image forming stations S1 to S4 have substantially the same configuration, comprising first to fourth photoconductive drums 3*a* to 3*d*, respectively, as image carriers which are rotated in a direction indicated by arrow F in FIG. 1. First to fourth chargers 4*a* to 4*d* for uniformly charging surfaces of the photoconductive drums 3*a* to 3*d*, first to fourth development devices 5*a* to 5*d* for developing electrostatic latent images formed on outer surfaces of the photoconductive drums 3*a* to 3*d* into visible images using a toner, first to fourth transfer rollers 6*a* to 6*d* (transfer means) for transferring the toner images (visible images) developed on the outer surfaces of the photoconductive drums 3*a* to 3*d* to the recording paper P, and cleaning devices 7*a* to 7*d* for removing the toner remaining on the outer surfaces of the photoconductive drums 3*a* to 3*d*, are provided around the photoconductive drums 3*a* to 3*d*, respectively, in sequence along a rotational direction (direction indicated by arrow F). Here, the cleaning devices 7*a* to 7*d* are each integrated with a container.

In addition, first to fourth exposure means 8*a* to 8*d* are provided over the photoconductive drums 3*a* to 3*d*, respectively. The exposure means 8*a* to 8*d* are writing means. The exposure means 8*a* to 8*d* use light generated by an LED, a laser, or the like to write an image based on image information onto the surfaces of the charged photoconductive drums 3*a* to 3*d*, respectively. As a result, electrostatic latent images are formed on the photoconductive drums 3*a* to 3*d*.

The first exposure means 8*a* of the first image forming station S1 located at a most upstream site in the transport direction of the transfer/transport belt 13, receives a pixel signal corresponding to a black color component image of a color original image. The second exposure means 8*b* of the second image forming station S2 next to the first image forming station S1, receives a pixel signal corresponding to a cyan color component image of the color original image. The third exposure means 8*c* of the third image forming station S3 next to the second image forming station S2, receives a pixel signal corresponding to a magenta color component image of the color original image. The fourth exposure means 8*d* of the fourth image forming station S4 located furthest downstream, receives a pixel signal corresponding to a yellow color component image of the color original image. As a result, electrostatic latent images corresponding to color-converted original image information are formed on the outer surfaces of the respective photoconductive drums 3*a* to 3*d*.

The first development device 5*a* of the first image forming station S1 accommodates a black color toner. The second development device 5*b* of the second image forming station S2 accommodates a cyan color toner. The third development device 5*c* of the third image forming station S3 accommodates a magenta color toner. The fourth development device 5*d* of the fourth image forming station S4 accommodates a yellow color toner. Electrostatic latent images on the outer surfaces of the photoconductive drums 3*a* to 3*d* are developed into visible images using these color toners. Thus, original image information is reproduced into toner images using color toners.

A charger for attracting recording paper (not shown) is provided between the first image forming station S1 and the transfer/transport belt 13. The recording paper attachment charger charges the surface of the transfer/transport belt 13 so that the transfer/transport belt 13 reliably attaches to the recording paper P and transports the recording paper P from the first image forming station S1 to the fourth image forming station S4 without displacement of the recording paper P.

The toner images are transferred from the photoconductive drums 3*a* to 3*d* to the recording paper P by the transfer rollers 6*a* to 6*d*, respectively, which contact a rear side of the transfer/transport belt 13. A high bias voltage for transfer having a polarity (+) reverse to the charged polarity (−) of the toner, is applied to each of the transfer rollers 6*a* to 6*d* in order to transfer the toner images. The transfer rollers 6*a* to 6*d* comprise a metal (e.g., stainless steel) shaft having a diameter of 8 to 10 mm and a conductive elastic material (e.g., EPDM, foam urethane, etc.) covering a surface of the metal shaft. With this conductive elastic material, it is possible to apply a high voltage uniformly to the recording paper P. By transferring the toner images to the recording paper P using the image forming stations S1 to S4, the recording paper P is attracted to the transfer/transport belt 13 and is transported by the transfer/transport belt 13 from the first image forming station S1 to the fourth image forming station S4 without displacement of the recording paper P. Although the transfer rollers 6*a* to 6*d* are used as transfer electrodes in this example, the transfer rollers 6*a* to 6*d* may be brushes.

Toner attached to the transfer/transport belt 13 due to the contact with the photoconductive drums 3*a* to 3*d* is responsible for soiling the rear surface of the recording paper P. Therefore, a transfer belt cleaning unit 13*a* is provided to remove or recover such a toner. The transfer belt cleaning unit 13*a* is provided with a cleaning blade (not shown) which contacts the transfer/transport belt 13. A portion of the transfer/transport belt 13 corresponding to a site where the cleaning blade contacts the transfer/transport belt 13 (under the third image forming station S3 and the fourth image forming station S4), is supported by a transfer/transport belt slave roller 13*b* from the rear side of the transfer/transport belt 13. Also, another transfer/transport belt slave roller 13*c* is provided under the first image forming station S1 to support the transfer/transport belt 13 from the rear side thereof.

A feed paper tray 19 for accumulating sheets of recording paper P for use in image formation is provided under an image forming section of the image forming apparatus X. An output tray 17, onto which the image-formed recording paper P is output face-down, is provided at an upper portion of the image forming apparatus X. Another output tray 18, onto which the image-formed recording paper P is output face-up, is provided at a side portion of the image forming apparatus X.

The image forming apparatus X is also provided with an S-shaped main paper transport path Sa which transports the recording paper P from the feed paper tray 19 via the transfer/transport belt mechanism 1 and the fixation device 2 to the output tray 17. Further, a transport mechanism section 300 comprising a pickup roller 19*a*, the registration rollers 10, 10, a transport direction switching guide 34, transport rollers 35, 35 for feeding the recording paper P, and the like, is provided along the main paper transport path Sa from the feed paper tray 19 to the output trays 17 and 18.

The transport rollers 35 are composed of small rollers which accelerate or assist transportation of the recording paper P. A plurality of transport rollers 35 are provided along the main paper transport path Sa.

The transport direction switching guide 34 is rotatably provided on a side cover Xa of the image forming apparatus X. The transport direction switching guide 34 is switched from a state indicated by a solid line into another state indicated by a dashed line, so that the recording paper P is departed from the main paper transport path Sa on its way to the output tray 17, and is then output to the output tray 18 provided at the side portion of the image forming apparatus X. When the transport direction switching guide 34 is in the state indicated by the solid line, the recording paper P is passed through a transport portion S' (a portion of the main paper transport path Sa) formed between the fixation device 2, the side cover Xa, and the transport direction switching guide 34, and is then output to the upper output tray 17.

Furthermore, a manual feed tray 41 for holding sheets of recording paper P for image formation is provided on a right-hand wall of the image forming apparatus X. The recording paper P is drawn out by a pickup roller 42 from the manual feed tray 41 and is then transported by transport rollers 43, 43 through a subsidiary paper transport path Sb. Thereafter, the recording paper P is transported through a transport path merging site Sc where the main paper transport path Sa and the subsidiary paper transport path Sb are joined into one path, to the registration rollers 10, 10. Thereafter, recording paper P from the manual feed tray 41 and recording paper P from the feed paper tray 19 are processed in the same manner.

Now, a characteristic feature of this example is that a sheet detecting sensor 51 for detecting an edge position of recording paper P to be transported to the first image forming station S1, is provided at the transport path merging site Sc of the main paper transport path Sa and the subsidiary paper transport path Sb, the site Sc being located upstream from the registration rollers 10, 10 in the recording paper transport direction.

At the transport path merging site Sc, recording paper P from the main paper transport path Sa is transported through the lower position, while recording paper P from the subsidiary paper transport path Sb is transported through the higher position. Therefore, the vertical position of the recording paper P cannot be specified at the transport path merging site Sc. Thus, the sheet detecting sensor 51 needs to accurately detect the edge position of the recording paper P even if the recording paper P varies vertically.

Figure 2:
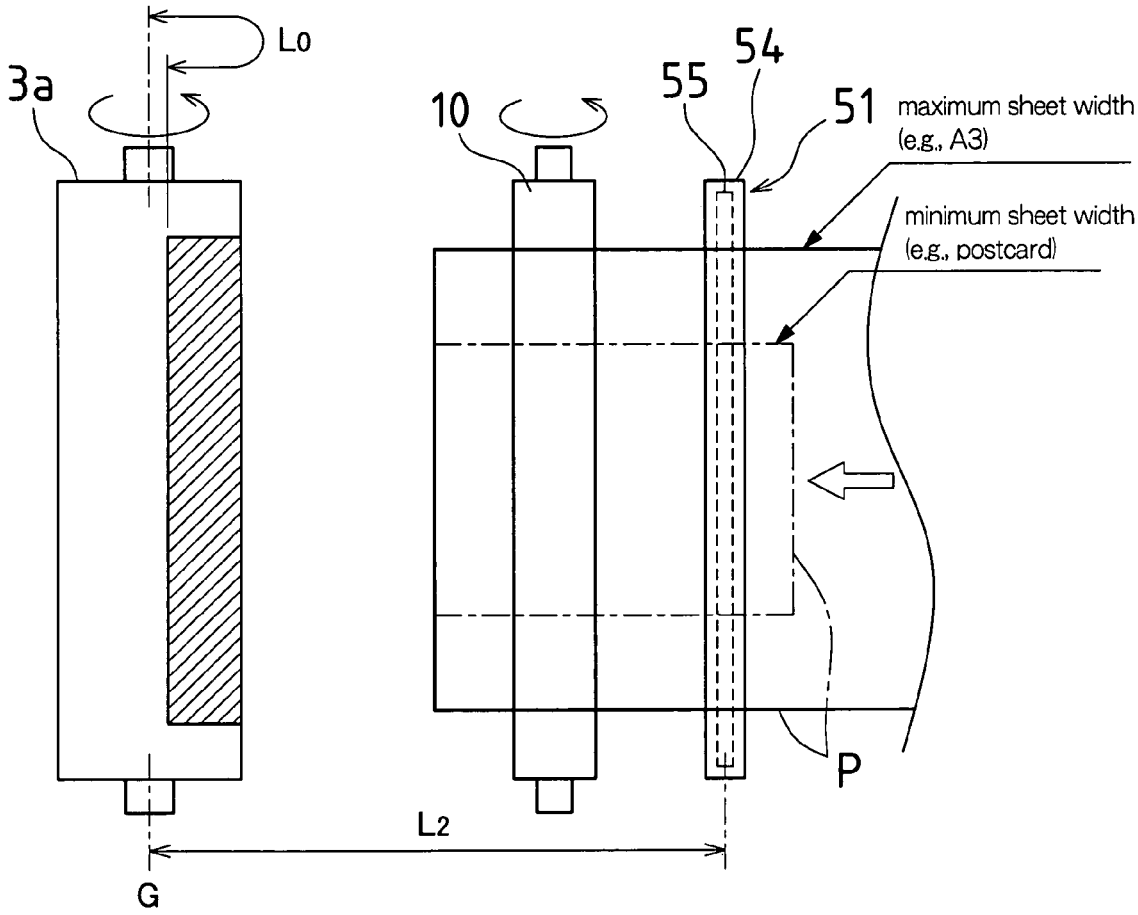
FIG. 2 is a plan view of the above-described sheet detecting sensor and a vicinity thereof, viewed from top.
Figure 3:
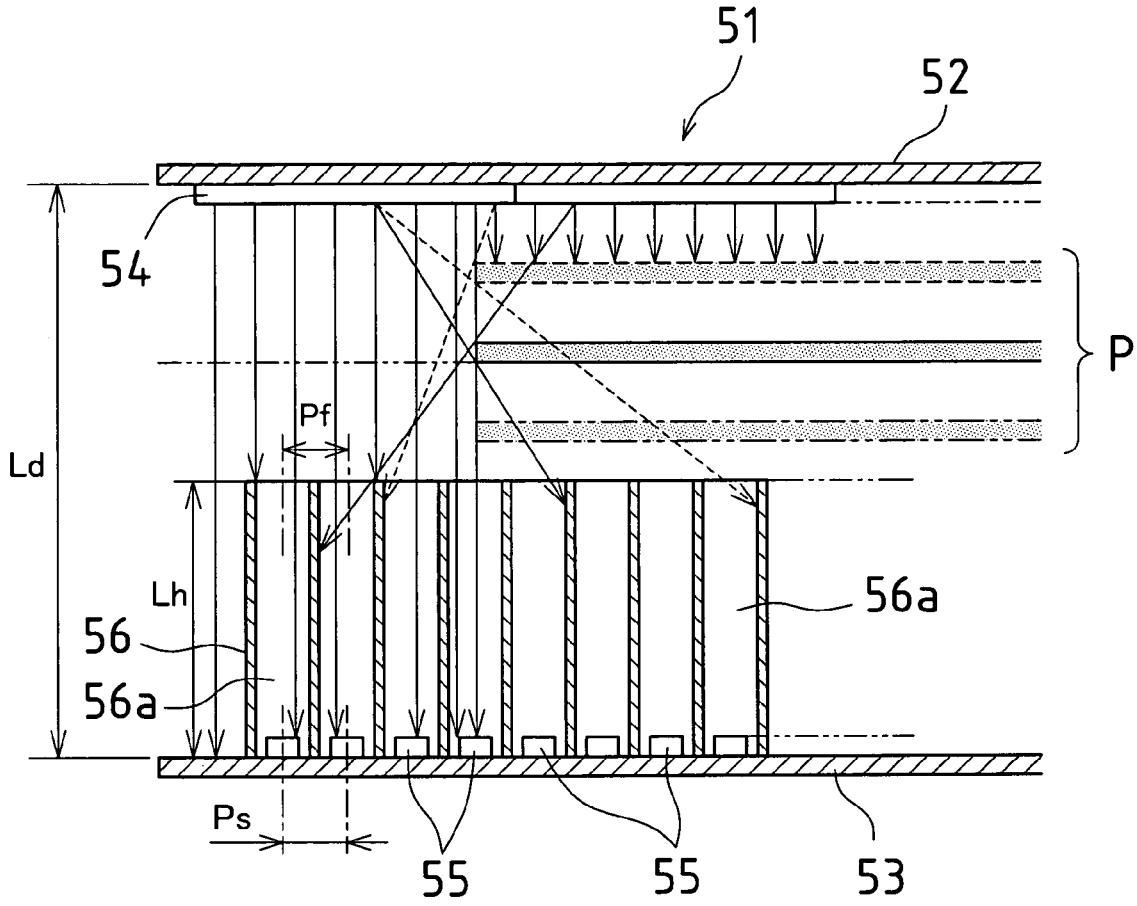
FIG. 3 is a partial cross-sectional view of the above-described sheet detecting sensor, viewed from front.

FIG. 2 is a plan view of the sheet detecting sensor 51 and a vicinity thereof, viewed from top. FIG. 3 is a partial cross-sectional view of the sheet detecting sensor 51, viewed from front. As can be clearly seen from FIGS. 2 and 3, the sheet detecting sensor 51 comprises an upper substrate 52 and a lower substrate 53 which interpose the transport path merging site Sc. The upper substrate 52 and the lower substrate 53 are spaced by a distance Ld, facing each other. A linear light emitting element 54 is fixed on the upper substrate 52 along a direction perpendicular to the transport direction of the recording paper P. A plurality of light receiving elements 55 are arranged in a line and are fixed on the lower substrate 53 along a direction perpendicular to the transport direction of the recording paper P. A hood 56 having a height Lh is provided on the lower substrate 53. A light receiving element 55 is provided in each opening portion 56*a* of the hood 56. The light receiving elements 55 are spaced in intervals Ps, which is equal to an interval Pf between each opening portion 56*a*.

Each opening portion 56*a* of the hood 56 serves as an optical path which passes only light from immediately above a corresponding light receiving element 55 into the light receiving element 55. An inner wall surface of each opening portion 56*a* is, for example, painted black to absorb light. Therefore, light obliquely entering the opening portions 56*a* is absorbed by the inner wall surfaces, so that only light emitted from immediately above a corresponding light receiving element 55 falls on the light receiving element 55.

Therefore, when the recording paper P is transported to the transport path merging site Sc, light emitted from the linear light emitting element 54 is blocked by the recording paper P from entering the light receiving elements 55 that are located immediately below the recording paper P. Only the light receiving elements 55 that are not immediately below the recording paper P receive light from the linear light emitting element 54. Light passing through a point in a vicinity of an edge portion of the recording paper P enters only that light receiving element 55 that is located immediately below that point, but not the other light receiving elements 55. In addition, even when the position of the recording paper P varies vertically, the same light receiving element 55 receives light passing through the same point in a vicinity of the edge portion of the recording paper P. Therefore, even when the position of the recording paper P varies vertically, the edge position of the recording paper P can be accurately detected, depending on which light receiving element 55 receives incident light.

Examples of the light emitting element 54 include a light emitting diode array, a fluorescent lamp, a combination of a light source and a light guide, and the like. A light source and a light guide are disclosed in JP 2003-97910A for example.

An example of the light receiving element 55 is a phototransistor array or the like. A range within which the light receiving elements 55 are arranged covers, for example, a size range of recording paper P from the maximum size to the minimum size where the maximum size corresponds to A3 (indicated by a solid line in FIG. 2) and the minimum size corresponds to postcard size (indicated by a dot-dashed line in FIG. 2).

The sheet detecting sensor 51 is designed to detect the edge position of the recording paper P when a predetermined time (e.g., 50 ms) has passed after the leading edge in the transport direction of the recording paper P abuts the registration rollers 10, 10. The predetermined time is a period of time which is required to adjust the position of the recording paper P by correcting the transport skew thereof after the leading edge in the transport direction of the recording paper P abuts the registration rollers 10, 10. The sheet detecting sensor 51 is designed to detect the edge position of the recording paper P when the predetermined time has passed after the leading edge in the transport direction of the recording paper P abuts the registration rollers 10, 10. The sheet detecting sensor 51 detects the edge position of the recording paper P when the leading edge in the transport direction of the recording paper P abuts the registration rollers 10, 10 and is stopped. After the edge position of the recording paper P is detected by the sheet detecting sensor 51, a position of an electrostatic latent image to be formed on the photoconductive drum 3*a*, i.e., an image formation region extending in a traverse direction perpendicular to the recoding paper transport direction, is set based on the result of detection of the edge position of the recording paper P.

Figure 4:
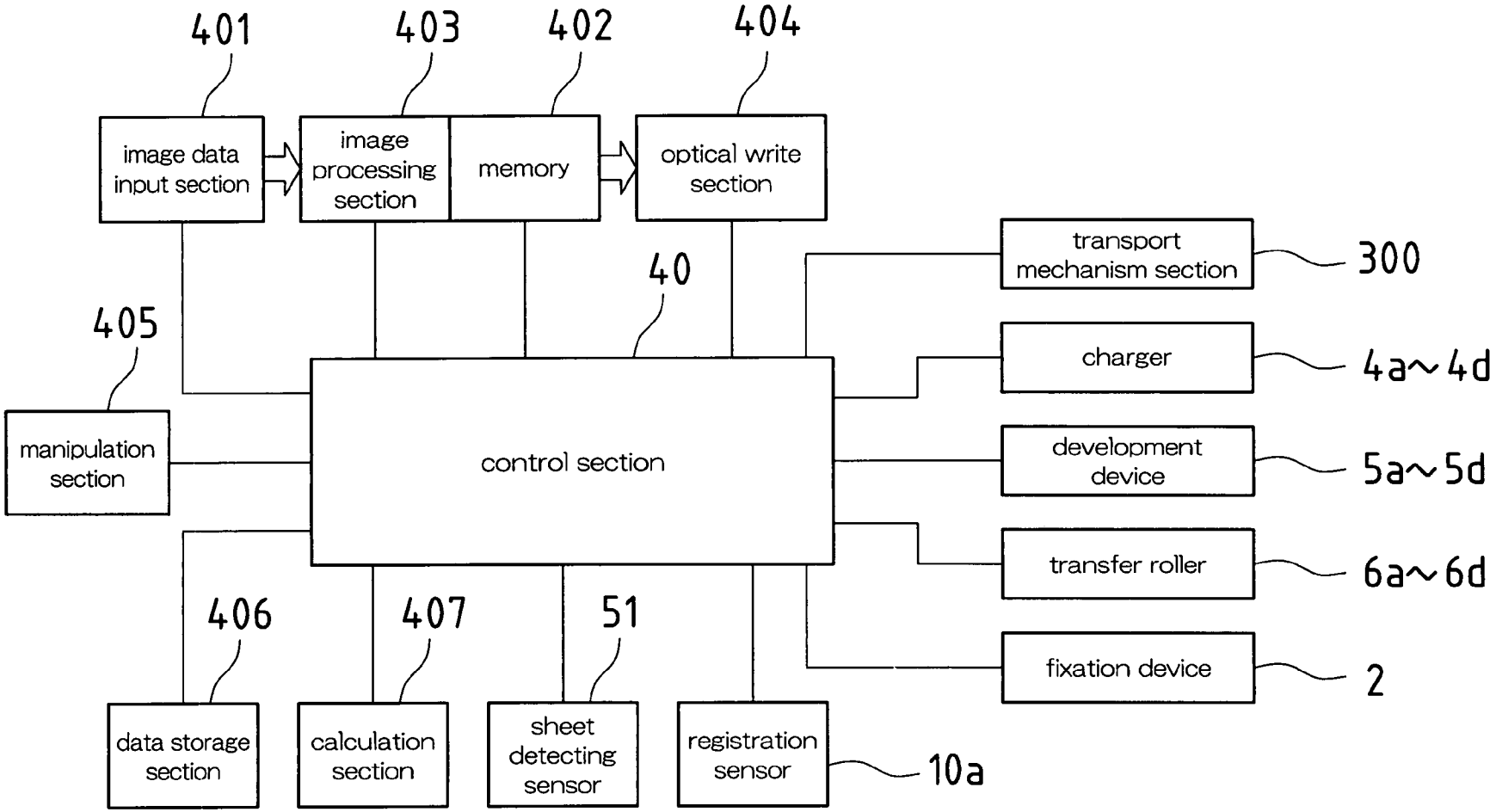
FIG. 4 is a block diagram showing a configuration of an image forming system of the above-described image forming apparatus.

FIG. 4 is a block diagram showing a configuration of an image forming system of the image forming apparatus X.

In FIG. 4, the image forming system comprises an image data input section 401, an image processing section 403 having a memory section 402, an optical write section 404, a manipulation section 405, a data storage section 406, a calculation section 407, a sheet detecting sensor 51, and a registration sensor 10*a*. Each section of the image forming system is controlled by a control section 40. Note that the image forming system further comprises the above-described transport mechanism section 300, chargers 4*a* to 4*d*, development devices 5*a* to 5*d*, transfer rollers 6*a* to 6*d*, exposure means 8*a* to 8*d*, and fixation device 2 (see FIG. 1).

The manipulation section 405 is provided with a switch (not shown) for switching image formation modes. When a no-margin image is formed on the recording paper P, an image formation mode is switched into a no-margin image formation mode. When an image formation mode is switched by the switch into the no-margin image formation mode, an electrostatic latent image (toner image) having a size slightly larger than the size of the recording paper P is written onto the photoconductive drum 3*a* of the first image forming station S1, based on the result (the size of the recording paper P) of detection of the edge position of the recording paper P by the sheet detecting sensor 51. Similarly, an electrostatic latent image (toner image) having a size slightly larger than the size of the recording paper P is written onto the photoconductive drums 3*b* to 3*d* of the second to fourth image forming stations S2 to S4, based on the result of detection of the edge position of the recording paper P by the sheet detecting sensor 51.

Figure 5:
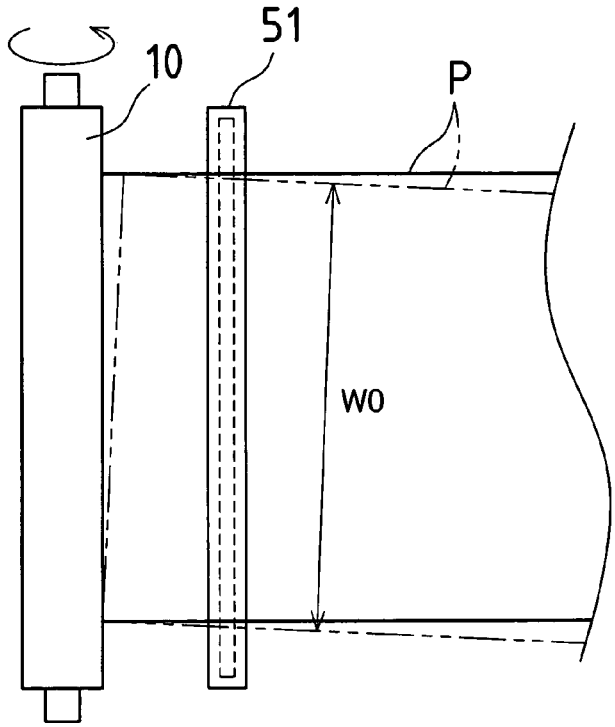
FIG. 5 is a diagram for explaining a state of recording paper, a position of which is adjusted by correcting the transport skew of the recording paper by registration rollers abutting a leading edge of the recording paper in the above-described image forming apparatus.
Figure 6:
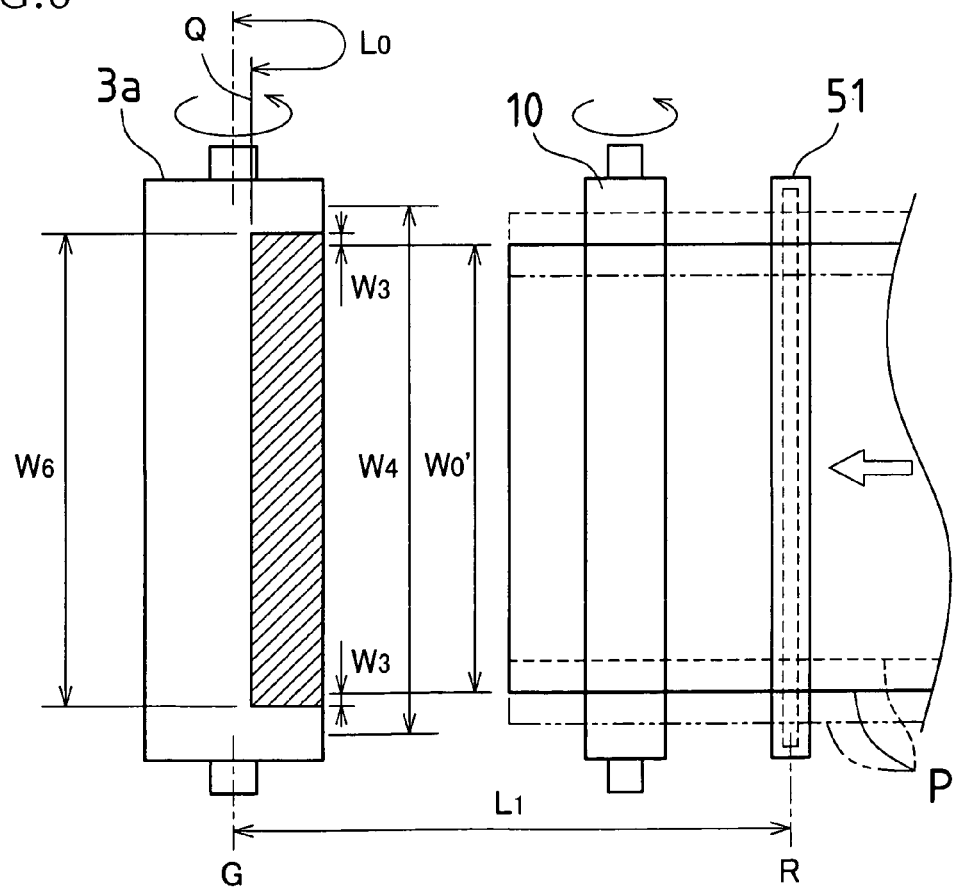
FIG. 6 is a diagram for explaining an image formation region for an image to be formed on a first photoconductive drum in the above-described image forming apparatus.

Specifically, a no-margin image is formed on the recording paper P as follows. Recording paper P having a traverse width W0 (a width in a lateral direction perpendicular to the recording paper transport direction) is transported to reach the registration rollers 10, 10 as indicated with a dot-dot-dashed line in FIG. 5. In this case, as indicated with a solid line in FIG. 5, the transport skew of the recording paper P is corrected by fitting the leading edge position of the recording paper P to the registration rollers 10, 10. After the position adjustment by the correction, the sheet detecting sensor 51 detects an edge position of the recording paper P (a position of the edges of the recording paper P parallel to the transport direction). Based on the result of the detection, an effective width W0' in the direction perpendicular to the recording paper P transport direction is obtained as shown in FIG. 6. Extra spaces W3, W3 of about 1 mm are added to opposite sides of the effective width W0' to obtain an image formation region W6 (W0'+W3×2) in the traverse direction perpendicular to the recording paper transport direction. An electrostatic latent image having the image formation region W6 in the traverse direction is written onto the photoconductive drum 3*a* of the image forming station S1 using the first exposure means 8*a*. Thereafter, the electrostatic latent image is developed by the development apparatus 5*a* to form a toner image having the image formation region W6 which is larger than the traverse width W0 of the recording paper P. In this case, a position and a magnification factor of an image to be formed on the recording paper is set based on the traverse width W0 (predetermined value) of the recording paper P and the image formation region W6 in the traverse direction of the input electrostatic latent image. This setting may be performed automatically, or manually in accordance with manipulation guidance output from the image forming apparatus X.

Similarly, an electrostatic latent image having a size slightly larger than the size of the recording paper P (an electrostatic latent image having the same size as that of the electrostatic latent image written onto the photoconductive drum 3*a* of the first image forming station S1) is written onto the photoconductive drums 3*b* to 3*d* of the second to fourth image forming stations S2 to S4, based on the result of detecting the edge position of the recording paper P by the sheet detecting sensor 51. In the case of the tandem-type image forming apparatus X of this example, color displacement may become a problem when a multi-color image is formed, leading to a reduction in image quality. However, in the image forming apparatus X, a color registration correction control is performed to suppress such an image quality reduction, resulting in a satisfactory image quality. Specifically, the data storage section 406 of the image forming apparatus X previously stores data for correcting the position of an image to be formed on the other photoconductive drums 3*b* to 3*d* with respect to a reference photoconductive drum (e.g., the most upstream photoconductive drum 3*a*). Based on the data, the position of an image to be formed on each of the photoconductive drums 3*b* to 3*d* is corrected so that images are registered on the photoconductive drums 3*b* to 3*d* without positional displacement, resulting in no occurrence of color displacement.

A position of an electrostatic latent image in a subsidiary scanning direction (a direction parallel to the recording paper P transport direction) on the photoconductive drum 3*a*, which is to be transferred to the recording paper P, is set by the registration rollers 10, 10 based on the timing of feeding the recording paper P in relation to the toner image on the photoconductive drum 3*a*.

Next, an image forming procedure, in which an electrostatic latent image is written based on the result of detection of the edge position of the recording paper P by the sheet detecting sensor 51 in the image forming apparatus of FIG. 1, will be described with reference to a flowchart shown in FIG. 7.

Figure 7:
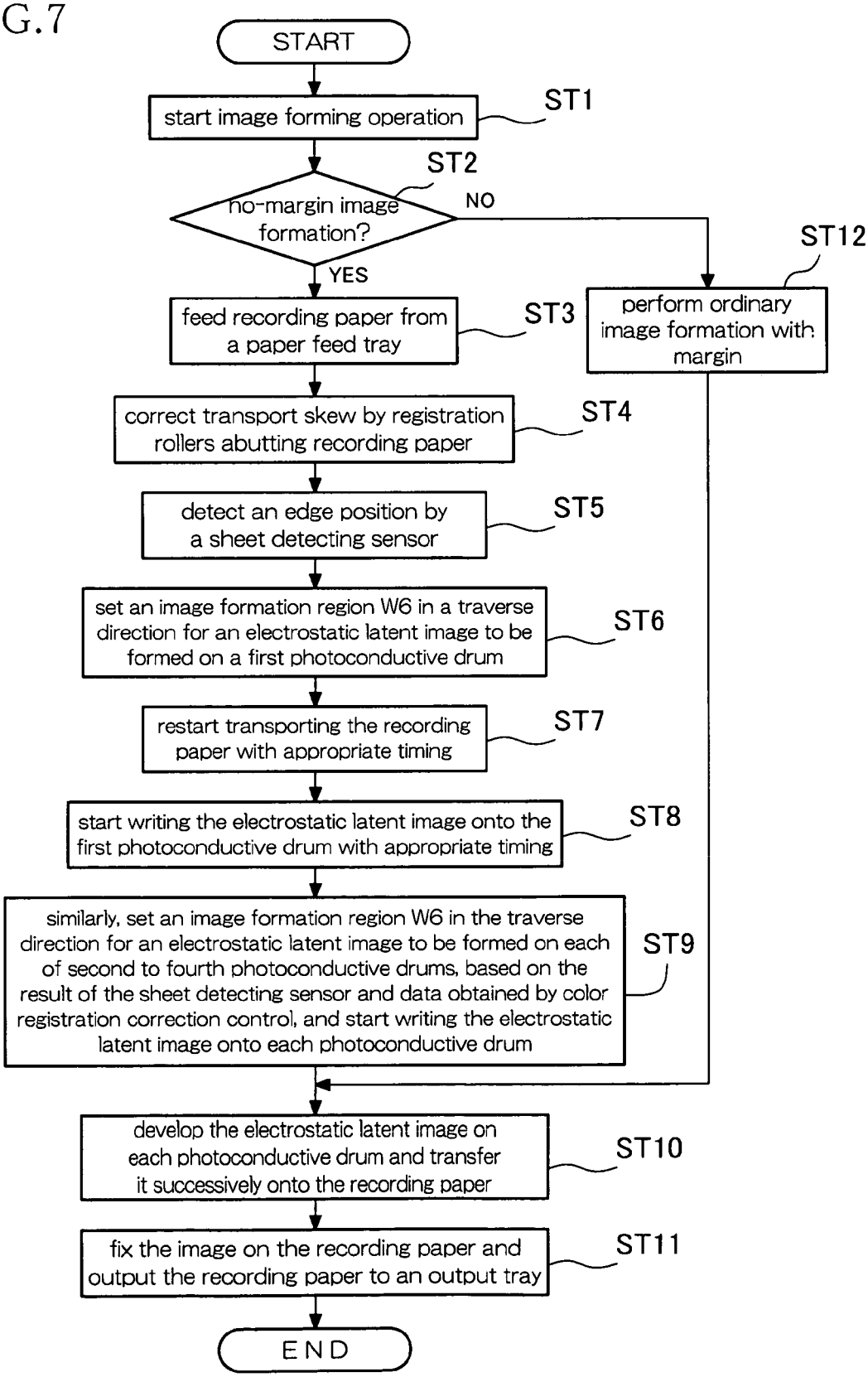
FIG. 7 is a flowchart showing an image forming procedure, in which an electrostatic latent image is written based on the result of detection of an edge portion of recording paper by the above-described sheet detecting sensor.

In step ST1 of the flowchart of FIG. 7, an image forming operation is started by pressing a start button of the manipulation section 405. Thereafter, in step ST2, it is determined whether or not the no-margin image formation mode is selected by the switch.

When it is determined in step ST2 that the no-margin image formation mode is selected (YES), recording paper P is picked up from the feed paper tray 19 or the manual feed tray 14 and the recording paper P is transported to the transport path merging site Sc in step ST3.

Next, in step ST4, the leading edge of the recording paper P transported to the transport path merging site Sc is caused to abut the registration rollers 10, 10 so that the transport skew of the recording paper P is corrected, i.e., the position of the recording paper P is adjusted. Thereafter, in step ST5, an edge position of the recording paper P close to the leading edge portion in the transport direction of the recording paper P is detected by the sheet detecting sensor 51 when the above-described predetermined time has passed after the leading edge in the transport direction of the recording paper P abuts the registration rollers 10, 10.

Thereafter, in step ST6, an image formation range of an electrostatic latent image to be formed on the photoconductive drum 3*a* is set based on the result of detection of the edge position of the recording paper P. Specifically, the image formation range is the image formation region W6 (W0'+ W3×2) in the traverse direction perpendicular to the recording paper transport direction.

Thereafter, in step ST7, the registration rollers 10, 10 are driven with appropriate timing to feed the recording paper P to the transfer/transport belt 13 and restart transporting the recording paper P. In step ST8, writing of an electrostatic latent image onto the photoconductive drum 3*a* of the first image forming station S1 is started with appropriate timing. Thereafter, in step ST9, an image formation region W6 in the traverse direction perpendicular to the recording paper transport direction is similarly set for an electrostatic latent image to be formed on each of the photoconductive drums 3*b* to 3*d* of the second to fourth image forming stations S2 to S4, based on the result of detection of the edge position of the recording paper P by the sheet detecting sensor 51 and data obtained by the color registration correction control. Thereafter, writing of the electrostatic latent image onto each of the photoconductive drums 3*b* to 3*d* is started.

Thereafter, in step ST10, the electrostatic latent images written on the photoconductive drums 3*a* to 3*d* of the first to fourth image forming stations S1 to S4, are developed by the development device 5*a* into toner images, which are in turn transferred successively onto the recording paper P on the transfer/transport belt 13. Thereafter, in step ST11, the images transferred on the recording paper P are fixed by the fixation device 2 and the recording paper P is then output to the output tray 17 or 18.

On the other hand, when it is determined in step ST2 that the no-margin image formation mode is not selected (NO), the process goes to step ST12, in which an ordinary image with margin is formed. Thereafter, the process goes to step ST10.

Next, a timing of writing an electrostatic latent image onto each of the photoconductive drums 3*a* to 3*d* of the first to fourth image forming stations S1 to S4, a timing of disconnecting a registration roller clutch for disconnecting a driving force to the registration rollers 10, 10, a timing of detecting the edge position of recording paper P by the sheet detecting sensor 51, and a detection timing of the registration sensor 10*a*, will be described with reference to a timing chart shown in FIG. 8.

Figure 8:
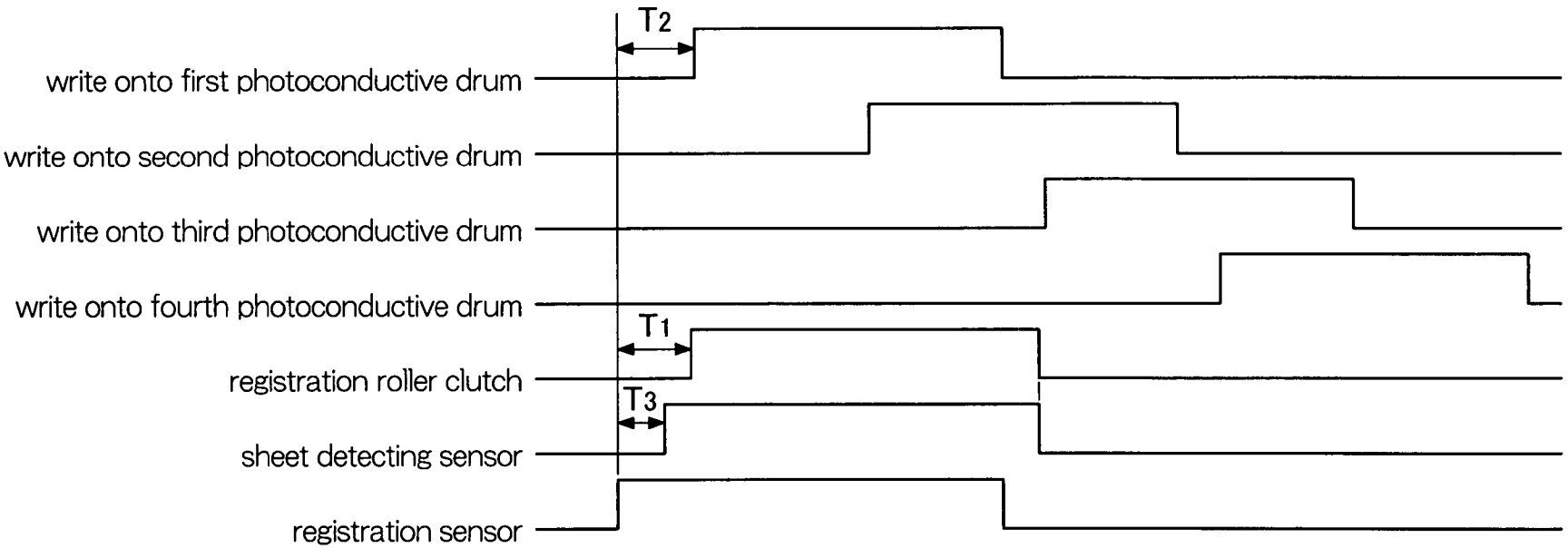
FIG. 8 is a timing chart showing a timing of writing an electrostatic latent image onto each photoconductive drum, a timing of disconnecting a registration roller clutch, a detection timing of the sheet detecting sensor, and a detection timing of a registration sensor in the above-described image forming apparatus.

In the timing chart of FIG. 8 (the image formation control of the image forming apparatus of FIG. 1), writing of an electrostatic latent image onto the photoconductive drum 3*a* of the first image forming station S1 is started T2 seconds after the time of start of detection by the registration sensor 10*a* (reference time). The time of T2 is later than the time of connection (ON) of the registration roller clutch, which occurs T1 seconds after the reference time. Detection of the edge position (lateral edge positions) of the recording paper P parallel to the recording paper P transport direction by the sheet detecting sensor 61, is started T3 seconds after the start (ON) of detection by the registration sensor 10*a*. Specifically, the leading edge of the recording paper P abuts the registration rollers 10, 10 at substantially the same time as the start (ON) of detection by the registration sensor 10*a*. Thereafter, the position of the recording paper P is adjusted by correcting the transport skew of the recording paper P before T3 seconds (<T2 seconds) have passed.

After the edge position of the recording paper P is detected by the sheet detecting sensor 51, an image formation region W6 in the traverse direction perpendicular to the recording paper transport direction is set for an electrostatic latent image to be formed on the photoconductive drum 3*a* of the first image forming station S1, based on the result of the detection. Based on the setting, writing of the electrostatic latent image onto the photoconductive drum 3*a* is started.

Further, writing of electrostatic latent images onto the photoconductive drums 3*b* to 3*d* of the second to fourth image forming stations S2 to S4 by the exposure means 8*b* to 8*d*, is performed in predetermined time intervals from the start of writing of an electrostatic latent image onto the photoconductive drum 3*a* of the first image forming station S1.

In this case, the reading timing of the sheet detecting sensor 51 indicates a time during which the sheet detecting sensor 51 actually reads the recording paper P. The connection of the registration roller clutch is cut (OFF) at a time point when an edge position at a trailing edge portion of the recording paper P is detected by the sheet detecting sensor 51.

Therefore, in this example, the sheet detection registration sensor 51 is provided upstream, in the recording paper transport direction, from the registration roller 10, 10. The sheet detecting sensor 51 detects the edge position of the recording paper P when a predetermined time (e.g., 50 ms) has passed after the leading edge in the transport direction of the recording paper P abuts the registration rollers 10, 10. The predetermined time is a period of time which is required to adjust the position of the recording paper P by correcting the transport skew thereof after the leading edge in the transport direction of the recording paper P abuts the registration rollers 10, 10. Therefore, the edge position of the recording paper P, which is stopped with the transport skew thereof being corrected by the registration rollers 10, 10, is detected with very high accuracy.

A light receiving element 55 is provided for each opening portion 56*a* of the hood 56 so that only light emitted from immediately above the light receiving element 55 is guided down to the light receiving element 55. Therefore, even when the position of the recording paper P varies vertically, the edge position of the recording paper P can be accurately detected.

Based on the result of detection of the edge position of the recording paper P by the sheet detecting sensor 51, an image formation region W6 in the traverse direction perpendicular to the recording paper transport direction is set for an electrostatic latent image to be formed on the photoconductive drum 3*a* of the first image forming station S1 so that the image formation region W6 matches the recording paper P. As a result, the quality of a formed image can be satisfactorily assured. Also, when no-margin image formation is performed, an image formation region W6 in the traverse direction perpendicular to the recording paper transport direction is set for an electrostatic latent image to be formed on the photoconductive drum 3*a* of the first image forming station S1, based on the result of detection of the edge position of the recording paper P when the predetermined time has passed after the leading edge in the transport direction of recording paper P abuts the registration rollers 10, 10, so that the size of the oversized image for image formation can be reduced to the extent possible. Therefore, the amount of toner, which is not transferred to recording paper P and is recovered, can be reduced to the extent possible. Thus, the amount of waste toner can be suppressed, resulting in economical toner consumption. In addition, a time required to fill a waste toner container with recovered toner can be elongated. Furthermore, in the cleaning devices 7*a* to 7*d* integrated with the container for recovering toner, it is possible to suppress uneven accumulation of recovered toner, i.e., partial large accumulation of recovered toner, whereby imperfect cleaning due to partial leakage of the recovered toner can be avoided. Also, in the second to fourth image forming stations S2 to S4, the same effect as that of the first image forming station S1 can be achieved.

Moreover, as the sheet detecting sensor 51 is located upstream, in the recording paper transport direction, from the registration rollers 10, 10, there are no longer constraints for a distance L2 from a transfer point G, where an image is transferred onto the recording paper P, to a detection point of the sheet detecting sensor 51. Thereby, a size of the image forming apparatus X can be reduced and a time required for image formation can be reduced. This is achieved by the following procedure: the edge position of the recording paper P abutting the registration rollers 10, 10 is detected by the sheet detecting sensor 51; based on the result of detection of the edge position of the recording paper P, an image formation region is set for the photoconductive drum 3*a* of the first image forming station S1; and transportation of the recording paper P is started by the registration rollers 10, 10 with appropriate timing for the formation of an electrostatic latent image on the photoconductive drum 3*a*. Therefore, it is also possible for the registration rollers 10, 10 to start transporting the recording paper P after the start of formation of an electrostatic latent image onto the photoconductive drum 3*a*. In this case, a distance L1 from the transfer point G, where an image is transferred onto the recording paper P, to a registration point R of the registration rollers 10, 10, can be shorter (e.g., see FIG. 6) than a distance L0 from a write point Q to the transfer point G. As a result, the size of the image forming apparatus X can be reduced and the time required for image formation can be reduced.

Note that when the distance L1 is equal to the distance L0, the formation of an electrostatic latent image on the photoconductive drum 3*a* and the transportation of the recording paper P by the registration rollers 10, 10 are started simultaneously. If the distance L1 is designed to be longer than the distance L0, the formation of an electrostatic latent image on the photoconductive drum 3*a* is started after the start of transportation of the recording paper P by the registration rollers 10, 10. In this case, the size of the image forming apparatus X is larger and the time required for image formation is longer.

In addition, the switch of the manipulation section 405 can be used to select the no-margin image formation mode in which a no-margin image is formed on the recording paper P. When the no-margin image formation mode is selected by the switch, an image formation region W6 in the traverse direction perpendicular to the recording paper transport direction is set for an electrostatic latent image to be formed on the photoconductive drum 3*a* of the first image forming station S1 so that the image formation region W6 matches the recording paper P, based on the result of detection of the edge position of the recording paper P by the sheet detecting sensor 51. Therefore, only by switching into the no-margin image formation mode when a no-margin image is formed, an image formation region W6 in the traverse direction perpendicular to the recording paper transport direction is set for an electrostatic latent image to be formed on the photoconductive drum 3*a* based on the result of detection of the edge position of the recording paper P by the sheet detecting sensor 51. As a result, the recording paper P is prevented from lacking an image; the amount of waste toner, which is not transferred to the recording paper P and is recovered, can be suppressed; and a time required to fill the toner recovery containers of the cleaning devices 7*a* to 7*d* with recovered toner can be elongated.

Furthermore, the sheet detecting sensor 51 has a built-in illumination means. Therefore, the sheet detecting sensor 51 can be easily assembled into the image forming apparatus X.

Note that the sheet detecting sensor 51 may continue to perform detection of the edge position of the recording paper P until the trailing edge of the recording paper P on the transfer/transport belt 13 reaches the sheet detecting sensor 51. Alternatively, detection may be performed only at least two times, i.e., at the leading edge portion and the trailing edge portion of the recording paper P, depending on a size of the selected recording paper P, to detect the timing of passing of the leading edge of the recording paper P, the edge position parallel to the transport direction (positions of the lateral edges), and the timing of passing of the trailing edge.

<Variation 1>

In Example 1, the no-margin image formation mode, in which a no-margin image is formed on the recording paper P, can be selected using a switch of the manipulation section 405. However, such a switch for selecting the no-margin mode does not have to be provided.

Specifically, an image forming procedure, in which an electrostatic latent image is written onto the recording paper P based on the result of detection of the edge position of the recording paper P by the sheet detecting sensor 51, will be described with reference to a flowchart shown in FIG. 9.

Figure 9:
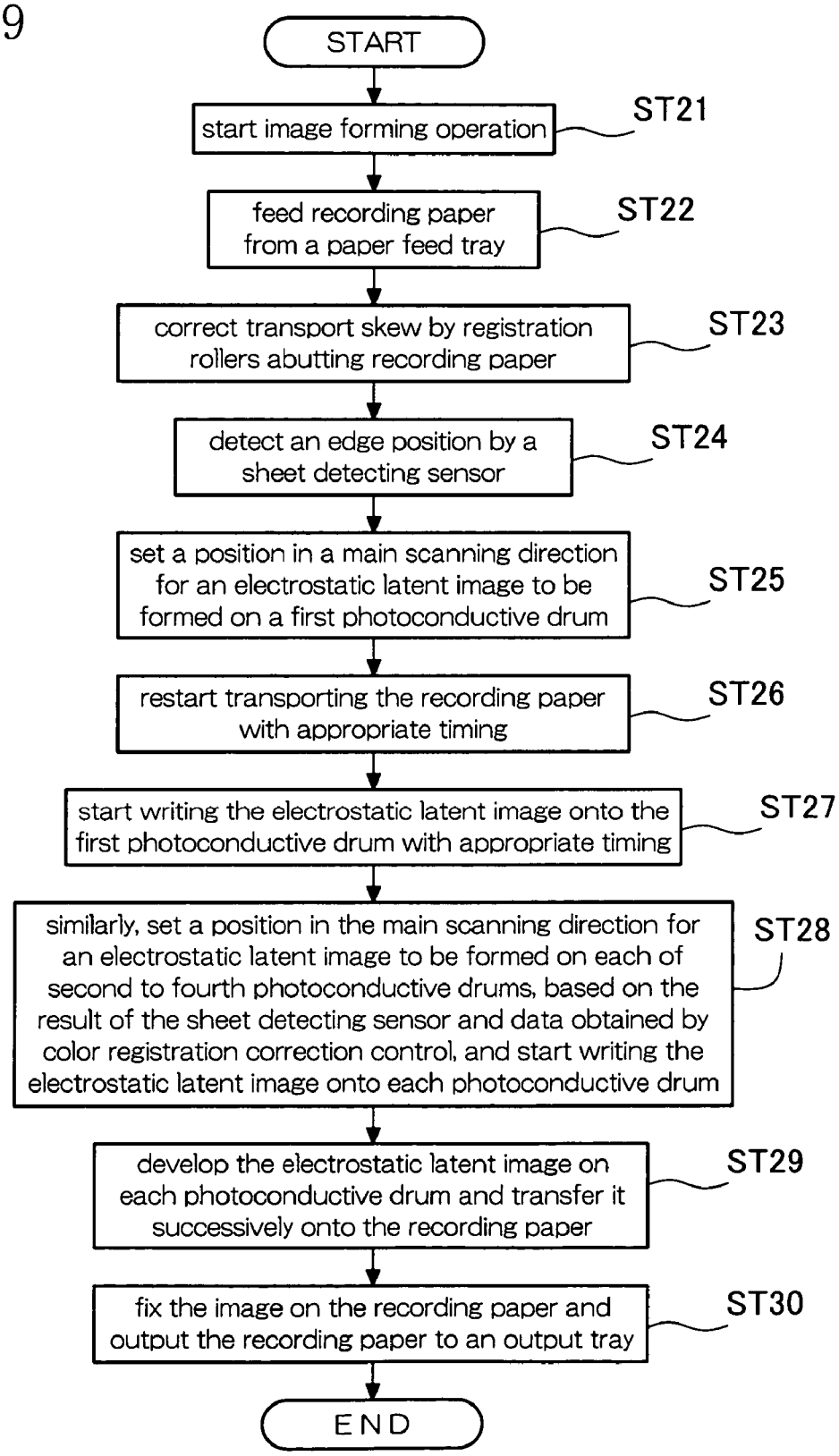
FIG. 9 is a flowchart showing an image forming procedure, in which an electrostatic latent image is written based on the result of detection of an edge portion of recording paper by a sheet detecting sensor according to a variation of Example 1 of the present invention.

In step ST21 of the flowchart of FIG. 9, an image forming operation is started by pressing a start button of the manipulation section 405. Thereafter, in step ST22, recording paper P is picked up from the feed paper tray 19 or the manual feed tray 14 and the recording paper P is transported to the transport path merging site Sc.

Next, in step ST23, the leading edge of the transported recording paper P is caused to abut the registration rollers 10, 10 so that a position of the recording paper P is adjusted by correcting the transport skew of the recording paper P. Thereafter, in step ST24, an edge position of the recording paper P close to the leading edge portion in the recording paper P transport direction is detected by the sheet detecting sensor 51 when the predetermined time has passed after the leading edge in the transport direction of the recording paper P abuts the registration rollers 10, 10.

Thereafter, in step ST25, an image formation range of an electrostatic latent image to be formed on the photoconductive drum 3*a* is set based on the result of detection of the edge position of the recording paper P. Specifically, an image formation position in a main scanning direction perpendicular to the recording paper transport direction is set.

Thereafter, in step ST26, the registration rollers 10, 10 are driven with appropriate timing to feed the recording paper P to the transfer/transport belt 13 and restart transporting the recording paper P. In step ST27, writing of an electrostatic latent image onto the photoconductive drum 3*a* of the first image forming station S1 is started with appropriate timing. Thereafter, in step ST28, an image formation position in the main scanning direction perpendicular to the recording paper transport direction is similarly set for an electrostatic latent image to be formed on each of the photoconductive drums 3*b* to 3*d* of the second to fourth image forming stations S2 to S4, based on the result of detection of the edge position of the recording paper P by the sheet detecting sensor 51 and data obtained by the color registration correction control. Thereafter, writing of the electrostatic latent image onto each of the photoconductive drums 3*b* to 3*d* is started.

Thereafter, in step ST29, the electrostatic latent images written on the photoconductive drums 3*a* to 3*d* of the first to fourth image forming stations S1 to S4, are developed by the development device 5*a* into toner images, which are in turn transferred successively onto the recording paper P on the transfer/transport belt 13. Thereafter, in step ST30, the image transferred on the recording paper P is fixed by the fixation device 2 and the recording paper P is then output to the output tray 17 or 18.

<Variation 2>

Figure 10:
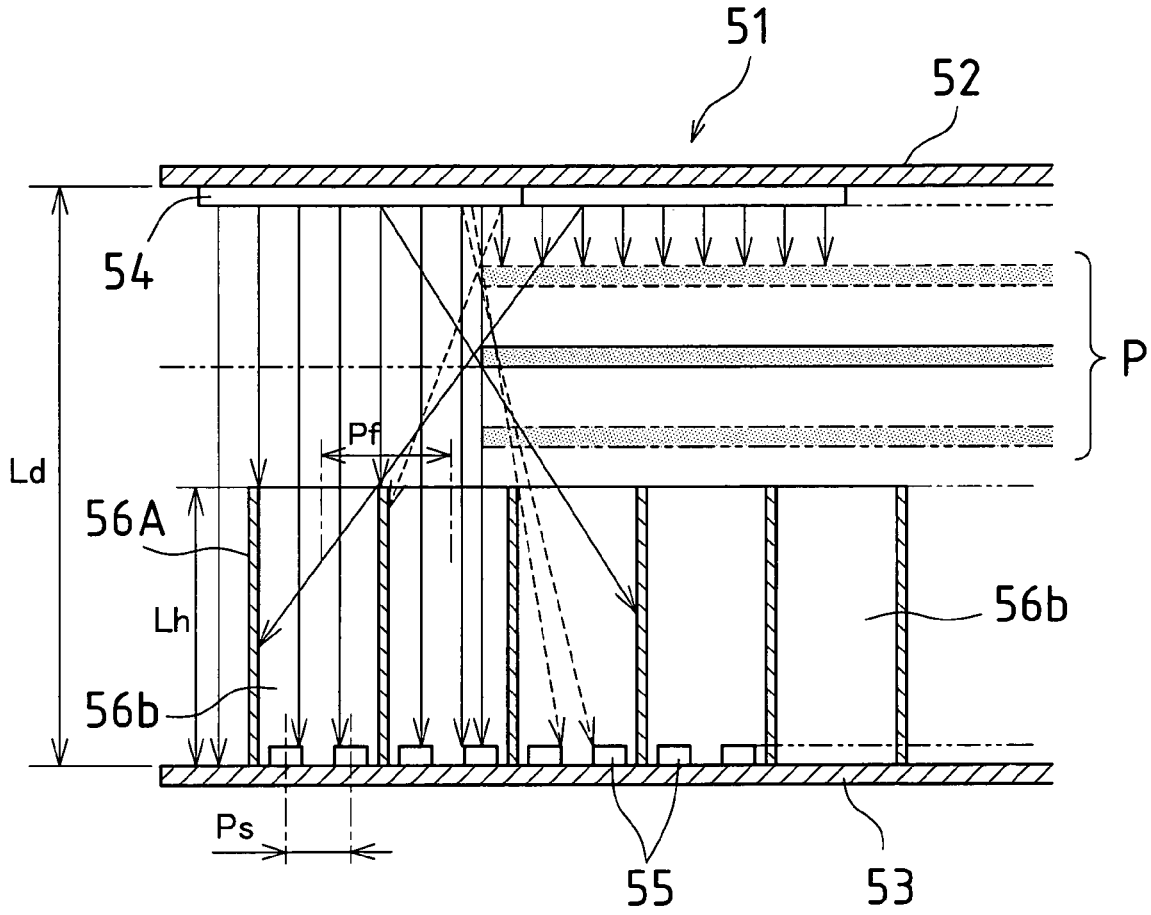
FIG. 10 is a partial cross-sectional view showing a variation of a sheet detecting sensor, viewed from front.

In the sheet detecting sensor 51, a hood 56A as shown in FIG. 10 may be used instead of the hood 56. Two light receiving elements 55 are provided for each opening portion 56*b* of the hood 56A. Therefore, an interval Ps between the light receiving elements 55 is ½ of an interval Pf between the opening portions 56*a*. For each opening portion 56*b*, light emitted substantially immediately above a pair of light receiving elements 55 is guided to the pair of light receiving elements 55. In this case, the accuracy of detecting the edge position of the recording paper P by the light receiving elements 55 arranged in a line is decreased, though the output level of the light receiving elements 55 is increased for each opening portion 56*b*.

Note that three or more light receiving elements 55 may be provided for each opening portion 56*b*.

<Variation 3>

Figure 11:
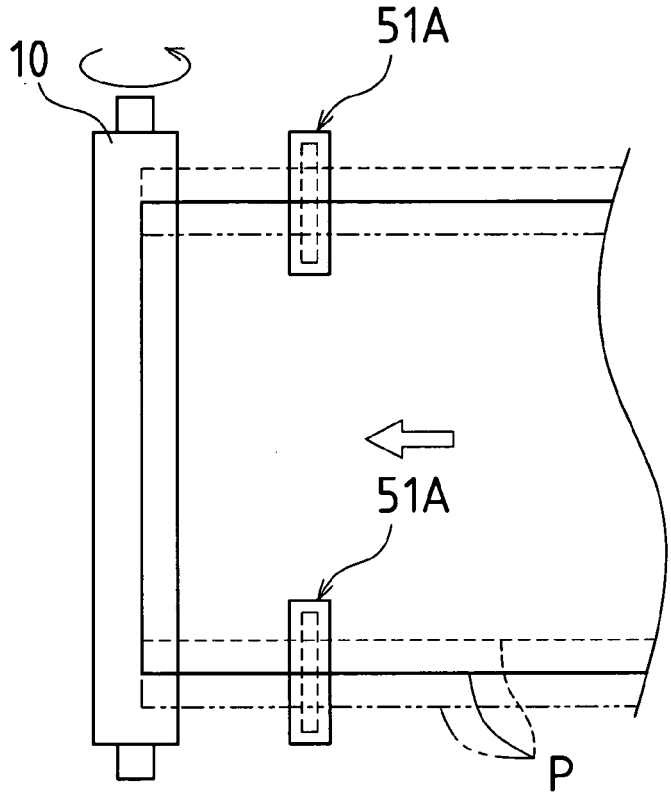
FIG. 11 is a partial cross-sectional view showing another variation of a sheet detecting sensor, viewed from top.

As shown in FIG. 11, two separate sheet detecting sensors 51A may be provided in a predetermined interval. The sheet detecting sensors 51A are disposed at positions such that opposite edges of recording paper P having a minimum size and recording paper P having a maximum size can be detected.

<Variation 4>

Figure 12:
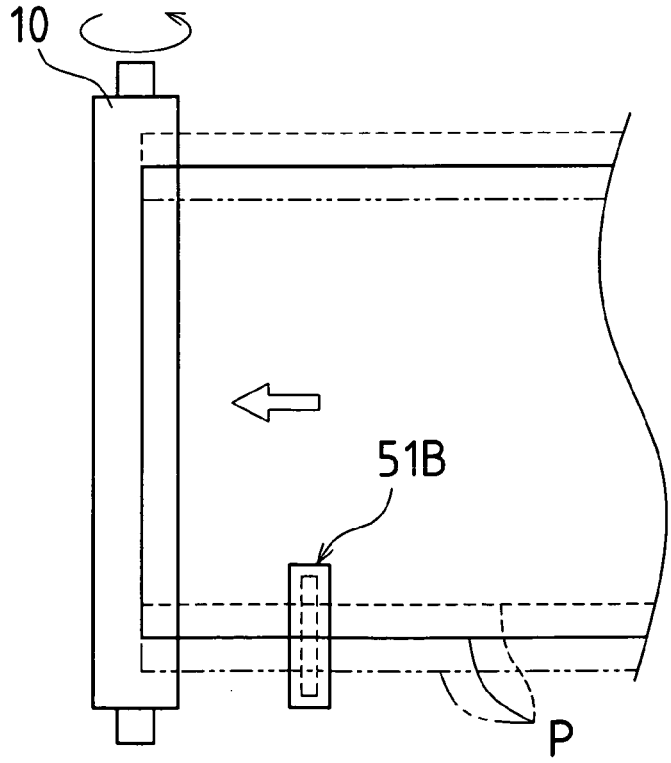
FIG. 12 is a partial cross-sectional view showing still another variation of a sheet detecting sensor, viewed from top.

Furthermore, as shown in FIG. 12, a short sheet detecting sensor 51B may be disposed at a position such that an edge of recording paper P having a minimum size and recording paper P having a maximum size can be detected.

Figure 13:
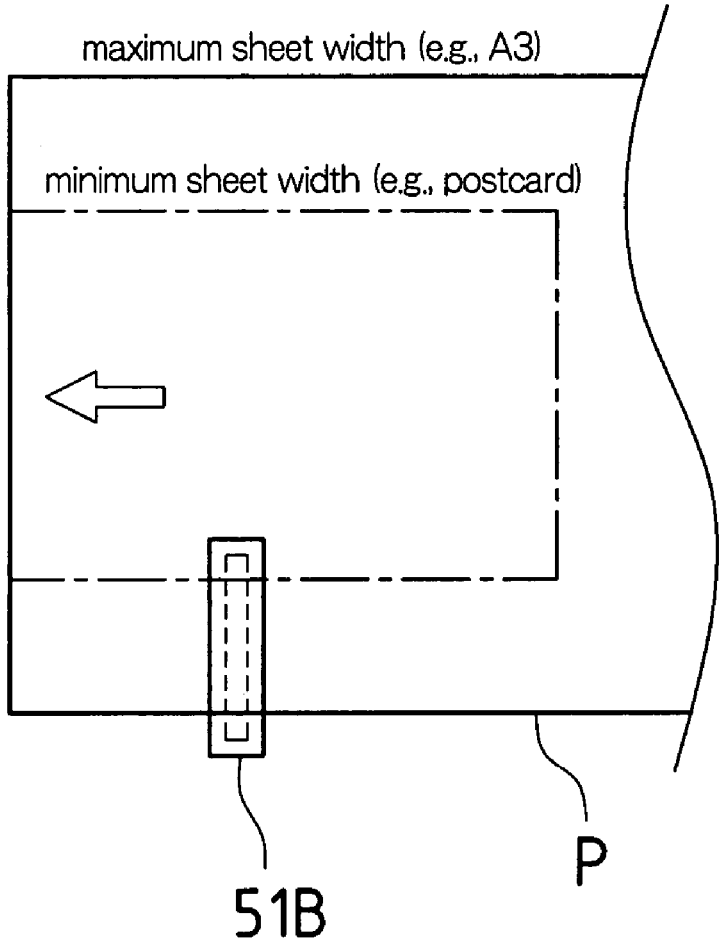
FIG. 13 is a plan view showing a detected state of an edge portion of recording paper detected by the sheet detecting sensor of FIG. 12.

In this case, it is assumed that recording paper P having various sizes is passed through a middle of the recording paper transport path. When an edge of the recording paper P is passed through a detection area of the sheet detecting sensor 51B and a position of the edge of the recording paper P is detected as shown in FIG. 13, a distance from a middle of the recording paper transport path to the edge is calculated, and thereafter, a position of the other edge is calculated, which is spaced by the calculated distance from the middle of the recording paper transport path toward the opposite side. Thereby, both edge positions of the recording paper P are detected.

Example 2

Next, Example 2 of the present invention will be described with reference to FIGS. 14 and 15.

In Example 2, the present invention is applied to a monochrome digital copier as an image forming apparatus.

Figure 14:
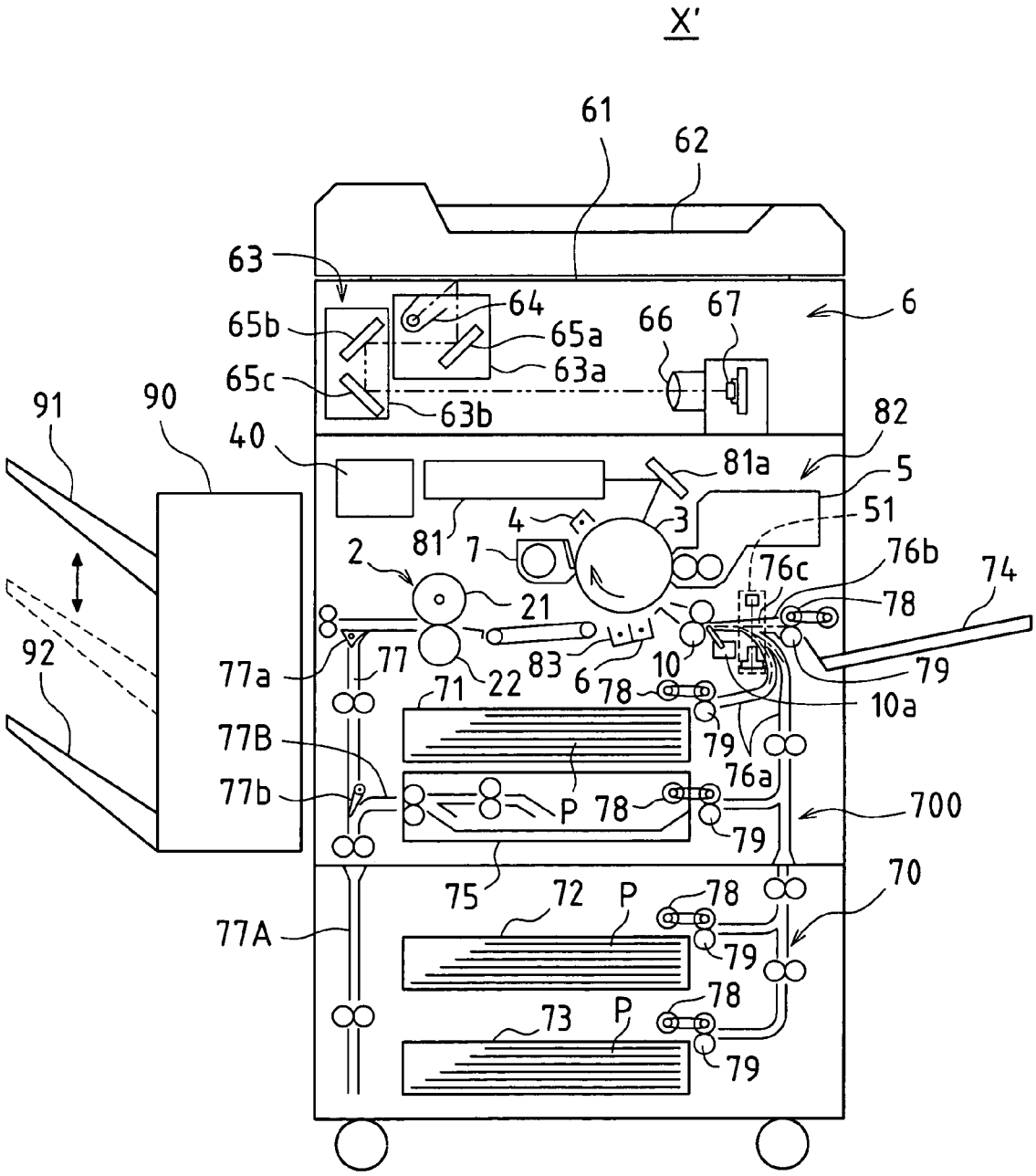
FIG. 14 is a diagram schematically showing a configuration of an electrophotographic monochrome digital copier according to Example 2 of the present invention.

Specifically, as shown in FIG. 14, a digital copier X' according to Example 2 of the present invention comprises a scanner section 6, an image forming system for forming an image onto the recording paper P, and a paper transport mechanism 700 for transporting the recording paper P to the image forming system. Hereinafter, each component will be described.

<Description of Scanner Section 6×

The scanner section 6 comprises a platen 61 made of transparent glass or the like, and a reversing automatic document feeder (RADF) 62 for feeding an original onto the platen 61. The scanner section 6 reads an image of the original on the platen 61 to generate image data.

The above-described RADF 62 comprises an automatic feed paper tray 62*a* for automatically feeding a plurality of originals set therein onto the platen 61 on a sheet-by-sheet basis. The RADF 62 is also designed to cause a scanner unit 63 described below to read either one or both sides of an original, depending on a user's choice. Specifically, the RADF 62 comprises a transport path for transporting an original from the automatic feed paper tray 62*a* to the platen 61, and a reverse path for reversing an original to cause the scanner unit 63 to read both sides of the original. When only one side of an original is read, only the transport path is used.

When both sides of an original are read, the original which has been transported via the transport path onto the platen 61 is reversed using the reverse path and is transported back onto the platen 61. To this end, each path is provided with a transport path switching means and a group of sensors for recognizing positions of an original on the path (both not shown). The configuration of the RADF 62 is conventionally well known and will not be explained in detail.

The scanner section 6 further comprises the above-mentioned scanner unit 63 for reading an image of an original transported onto the platen 61. The scanner unit 63 comprises a lamp reflector assembly 64, a plurality of reflection mirrors 65*a*, 65*b*, 65*c*, an optical lens assembly 66, and a photoelectric conversion element (CCD) 67.

The lamp reflector assembly 64 irradiates an original placed on the platen 61 with light. The reflection mirrors 65*a*, 65*b*, 65*c* provide an optical path indicated with a dot-dashed line in FIG. 14. Specifically, the reflection mirrors 65*a*, 65*b*, 65*c* reflect light reflected from an original to the left-hand direction in FIG. 14, then reflect the light downward, and then reflect the light to the right-hand direction in FIG. 14 toward the optical lens assembly 66.

An operation of reading an image of an original will be described below. When an original is placed on the platen 61, a first scanning unit 63*a* comprising the lamp reflector assembly 64 and a reflection mirror 65*a* is moved horizontally along the platen 61 to irradiate an entire original with light while scanning. In this case, a second scanning unit 63*b* comprising the reflection mirrors 65*b*, 65*c* is moved in the same direction as that of the first scanning unit 63*a* and at a speed having a predetermined ratio to the first scanning unit 63*a* (half the speed of the first scanning unit 63*a*). The light which has been reflected from the reflection mirrors 65*a*, 65*b*, 65*c* and passed through the optical lens assembly 66, is focused onto the photoelectric conversion element 67, which in turn converts the reflected light into an electric signal (original image data). The thus-obtained image data is transmitted to an image processing section (not shown) described below. The image processing section performs various processes. Thereafter, the processed data is temporarily stored in an image memory (not shown). The image data is read out from the image memory in response to an output command and is utilized in an image forming operation by an image formation system.

<Description of Image Formation System>

The image formation system comprises a laser write unit 81 and an electrophotographic processing section 82. The laser write unit 81 irradiates a surface of a photoconductive drum 3, which serves as an image carrier in the electrophotographic processing section 82, with laser light based on original image data converted by the photoelectric conversion element 67 or image data transmitted from a personal computer. Specifically, the laser write unit 81 has a semiconductor laser source for emitting laser light based on the image data, a polygon mirror for deflecting the laser light at a constant angular velocity, an f-θ lens for correcting the laser light deflected at a constant angular velocity so that the laser light scans the photoconductive drum 3 at a constant velocity, and the like.

The photoconductive drum 3 is rotated in a direction indicated with an arrow in FIG. 14. An electrostatic latent image is formed on the surface of the photoconductive drum 3 by irradiating with laser light which is emitted from the laser write unit 81 and is then reflected by the reflection mirror 81*a*.

The electrophotographic processing section 82 comprises a charger 4, a development device 5, a transferer 6, a charge eliminator 83, a detacher, a cleaning device 7, and a fixation device 2, which are placed around the photoconductive drum 3. The charger 4 charges the surface of the photoconductive drum 3 to a predetermined potential before formation of an electrostatic latent image. The development device 5 develops the electrostatic latent image formed on the surface of the photoconductive drum 3 into a visible image using a toner. The transferer 6 transfers the toner image formed on the surface of the photoconductive drum 3 onto the recording paper P. The fixation device 2 fixes the toner image, which has been transferred onto the recording paper P, by heat and pressure. The fixation device 2 comprises a heat roller and a pressure roller. The charge eliminator 83 eliminates residual charges from the surface of the photoconductive drum 3. The detacher and the cleaning device 7 remove the toner remaining on the surface of the photoconductive drum 3 after toner transfer. In this case, the cleaning device 7 is integrated with a container.

Thus, an image is formed onto the recording paper P as follows. The charger 4 charges the surface of the photoconductive drum 3 to a predetermined potential. The laser write unit 81 irradiates the surface of the photoconductive drum 3 with laser light based on image data to form an electrostatic latent image. Thereafter, the development device 5 develops the electrostatic latent image into a visible image using a toner on the surface of the photoconductive drum 3. The transferer 6 transfers the toner image onto the recording paper P fed from the paper transport mechanism 700. Thereafter, the fixation device 2 heats the recording paper P to fix the toner image. The charge eliminator 83 eliminates residual charges from the surface of the photoconductive drum 3. Further, the detacher and the cleaning device 7 remove the toner remaining on the surface of the photoconductive drum 3. In this manner, a cycle of image forming operation (print operation) to the recording paper P is completed. By performing this cycle repeatedly, image formation can be successively performed for a plurality of sheets of recording paper P, P . . . .

<Description of Paper Transport Mechanism 700>

The paper transport mechanism 700 transports sheets of recording paper P, P . . . , which are accommodated in first, second and third paper cassettes 71, 72, 73, and a multipurpose manual feed tray 74, on a sheet-by-sheet basis. After image formation is performed on the recording paper P by the above-described image formation system, the paper transport mechanism 700 outputs the recording paper P having a formed image onto a first or second output tray 91 or 92. The paper transport mechanism 700 further comprises a duplex copying unit 75 for recovering recording paper P, on one side of which image formation has been performed, and causing the image formation system to perform image formation on the other side of the recording paper P.

The paper cassettes 71, 72, 73 accommodate sheets of recording paper P, P . . . each having a different size. Sheets of recording paper P having a size desired by the user are picked up on a sheet-by-sheet basis from the corresponding paper cassette and are then transported successively via a transport path 70 into the image formation system.

The transport path 70 of the paper transport mechanism 700 includes a main transport path 76*a*, a subsidiary transport path 76*b*, and a reversing transport path 77.

The main transport path 76*a* has branched ends (upstream ends in the recording paper transport direction), which face the output side of the respective paper cassettes 71, 72, 73. The main transport path 76*a* travels through the transferer 6 and the fixation device 2. The other end of the main transport path 76*a* faces a postprocessing device 90 comprising the output trays 91, 92. The subsidiary transport path 76*b* faces an output side of the manual feed tray 74 and merges into the main transport path 76*a* at a transport path merging site 76*c*.

The reversing transport path 77 has an end (upper end in FIG. 14) which is connected to the main transport path 76*a* at a site downstream (left-hand side in FIG. 14) of the fixation device 2. The reversing transport path 77 is branched into first and second branch paths 77A, 77B at a halfway portion thereof (a middle portion in a vertical direction in FIG. 14). The first branch path 77A extends vertically downward, while the second branch path 77B has an end facing the input side of the duplex copying unit 75.

The connecting portion of the main transport path 76*a* and the reversing transport path 77 and the branching portion of the reversing transport path 77 are provided with first and second branching pawls 77*a*, 77*b*, respectively.

The first branching pawl 77*a* can freely swing around a horizontal shaft between a first position and a second position. In the first position, the first branching pawl 77*a* closes the reversing transport path 77. In the second position, the first branching pawl 77*a* blocks the output side of the main transport path 76*a* to cause the main transport path 76*a* to communicate with the reversing transport path 77. When the first branching pawl 77*a* is in the first position, the recording paper P is output directly from the image formation system to the output tray 91 or 92. When the first branching pawl 77*a* is in the second position, the recording paper P is supplied from the image formation system to the reversing transport path 77.

The second branching pawl 77*b* can freely swing around a horizontal shaft between a first position and a second position. In the first position, the second branching pawl 77*b* opens the first branch path 77A of the reversing transport path 77 while closing the second branch path 77B. In the second position, the second branching pawl 77*b* opens the second branch path 77B while closing the first branch path 77A. When the second branching pawl 77*b* is in the first position, the recording paper P transported to the reversing transport path 77 is guided into the first branch path 77A and is transported to a lower position of the first branch path 77A. Thereafter, when the second branching pawl 77*b* is in the second position, the recording paper is transported in the reverse direction into the second branch path 77B via the branching portion. Thereafter, the recording paper P is supplied to the duplex copying unit 75. In other words, by supplying recording paper P into the duplex copying unit 75 via the first and second branch paths 77A, 77B, the recording paper P is reversed when it is supplied to the image formation system. Therefore, image formation can be performed on the rear side of the recording paper P.

A pickup roller 78 is provided at each of the upstream ends of the main transport path 76*a* and the subsidiary transport path 76*b*, facing the output side of the paper cassettes 71, 72, 73, the manual feed tray 74, or the duplex copying unit 75. A plurality of paper feed rollers 79 is provided downstream from the pickup rollers 78 to feed the picked-up recording paper P to the main transport path 76*a* or the subsidiary transport path 76*b*. By rotation of the pickup roller 78 and the paper feed roller 79, sheets of recording paper P accommodated in the paper cassettes 71, 72, 73, the manual feed tray 74, and the duplex copying unit 75 can be selectively fed to the main transport path 76*a* on a sheet-by-sheet basis.

As described above, the digital copier X' of this example comprises a two-stage paper output section including the first and second output trays 91, 92. The postprocessing device 90 is provided with a transport path which connects a downstream end of the main transport path 76*a* to the output trays 91, 92. The transport path is designed to be switched into the first output tray 91 or the second output tray 92, depending on which tray the recording paper P is to be output onto.

Registration rollers 10, 10 are provided upstream, in the recording paper P transport direction, from the photoconductive drum 3. The registration rollers 10, 10 abuts a leading edge of the recording paper P successively transported to the image formation system via the transport path 70, and adjusts the position of the recording paper P by correcting the transport skew thereof.

A sheet detecting sensor 51 for detecting an edge position of recording paper P to be transported to the photoconductive drum 3, is provided at the transport path merging site 76*c* of the main transport path 76*a* and the subsidiary transport path 76*b*, the site 76*c* being located upstream of the registration rollers 10, 10 in the recording paper transport direction. The sheet detecting sensor 51 is provided along a direction perpendicular to the recording paper transport direction. The sheet detecting sensor 51 is designed to detect the edge position of the recording paper P when a predetermined time (e.g., 50 ms) has passed after the leading edge in the transport direction of the recording paper P abuts the registration rollers 10, 10. The predetermined time is a period of time which is required to adjust the position of the recording paper P by correcting the transport skew thereof after the leading edge in the transport direction of the recording paper P abuts the registration rollers 10, 10. The sheet detecting sensor 51 detects the edge position of the recording paper P when the leading edge in the transport direction of the recording paper P abuts the registration rollers 10, 10 and is stopped. After the edge position of the recording paper P is detected by the sheet detecting sensor 51, a size of an electrostatic latent image to be formed on the photoconductive drum 3, i.e., an image formation region extending in a traverse direction perpendicular to the recoding paper transport direction, is set based on the result of detection of the edge position of the recording paper P.

As described above, the sheet detecting sensor 51 comprises a light emitting element 54, a plurality of light receiving elements 55, and a hood 56 so that the edge position of recording paper P can be accurately detected even when the position of the recording paper P varies vertically.

Figure 15:
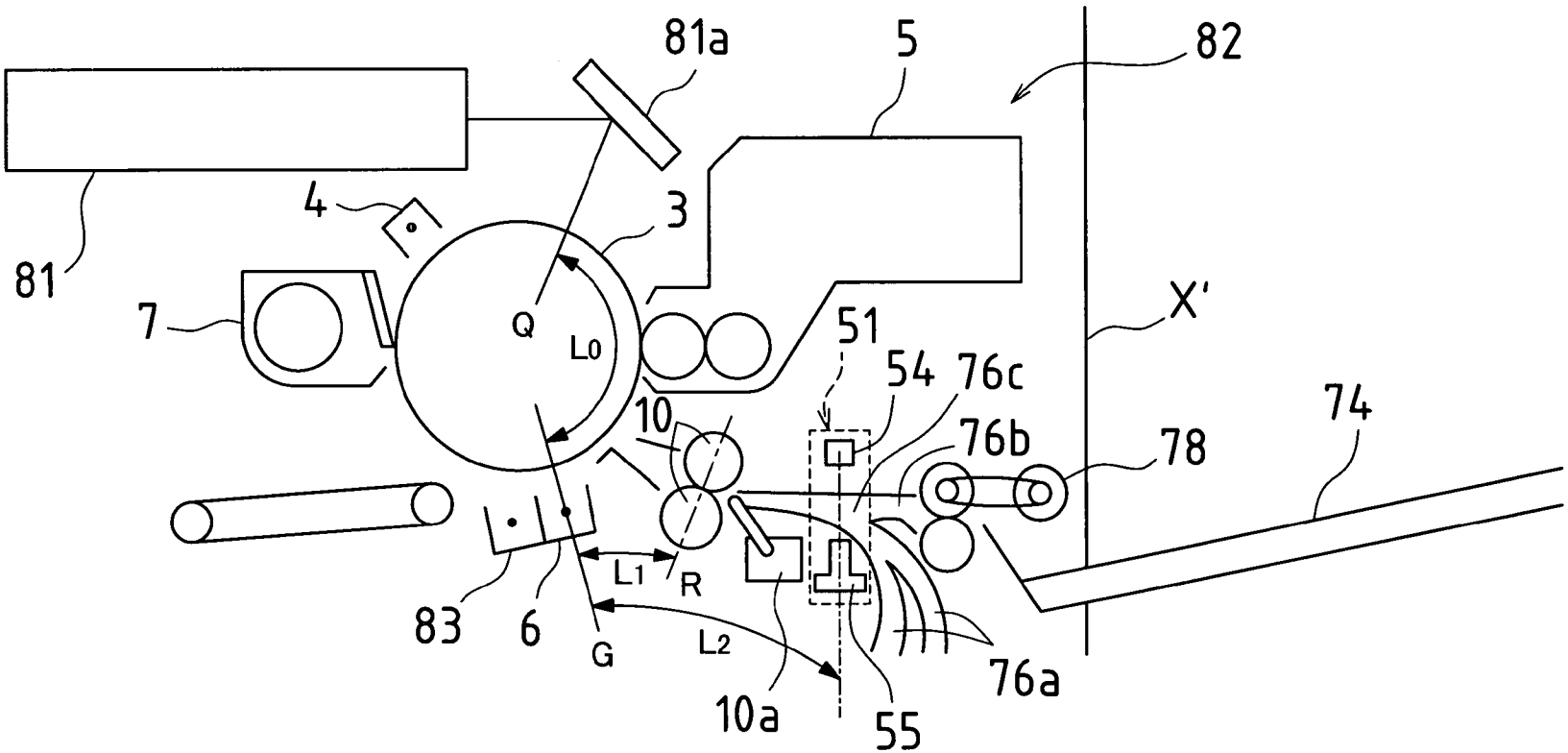
FIG. 15 is a diagram schematically showing a configuration of a photographic drum and a vicinity thereof in the copier of FIG. 14.
Figure 16:
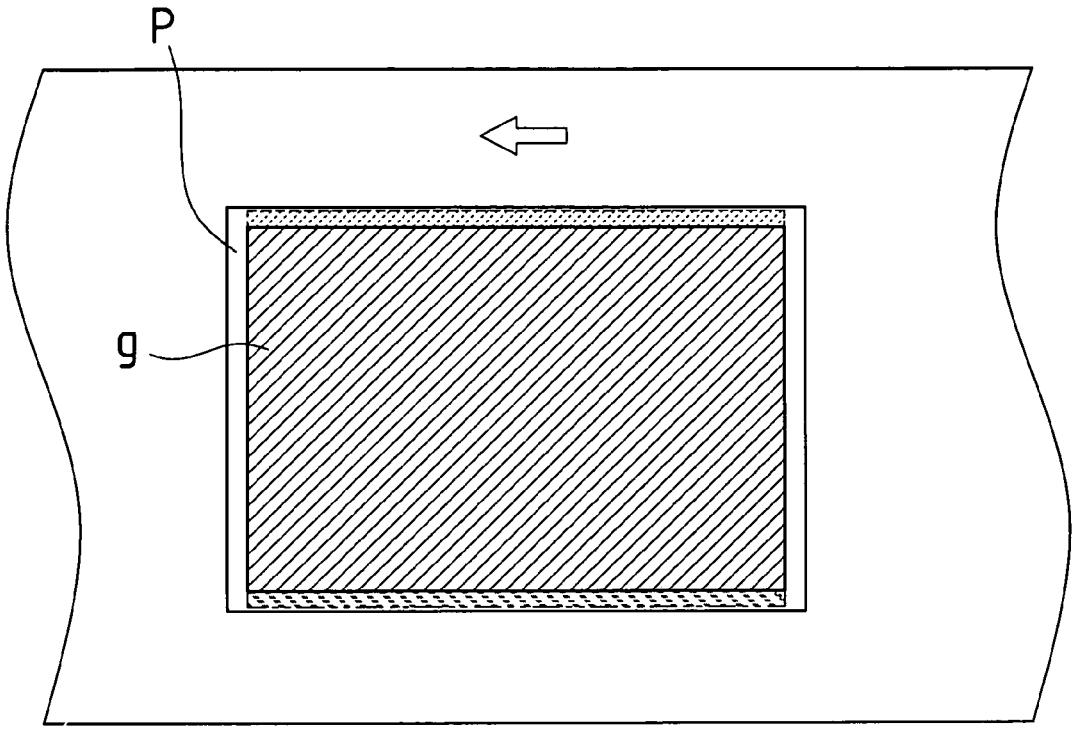
FIG.16 Prior Art
FIG. 16 is a diagram for explaining a positional displacement between a development-agent image and a sheet.
Figure 17:
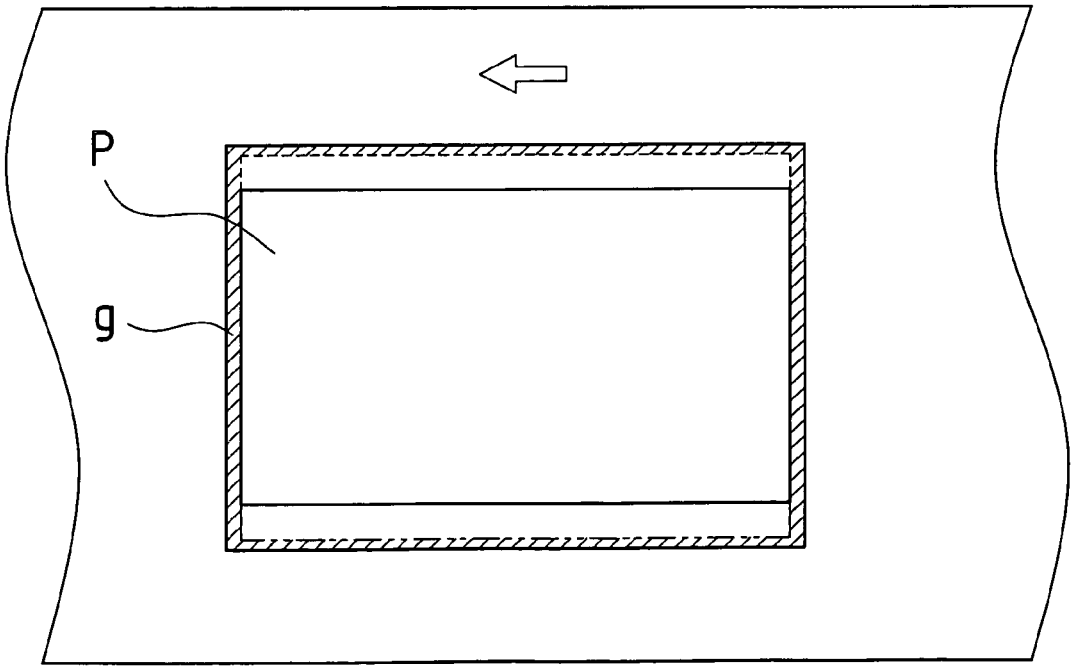
FIG.17 Prior Art
FIG. 17 is a diagram for explaining a procedure of forming an image on an entire sheet.
Figure 18:
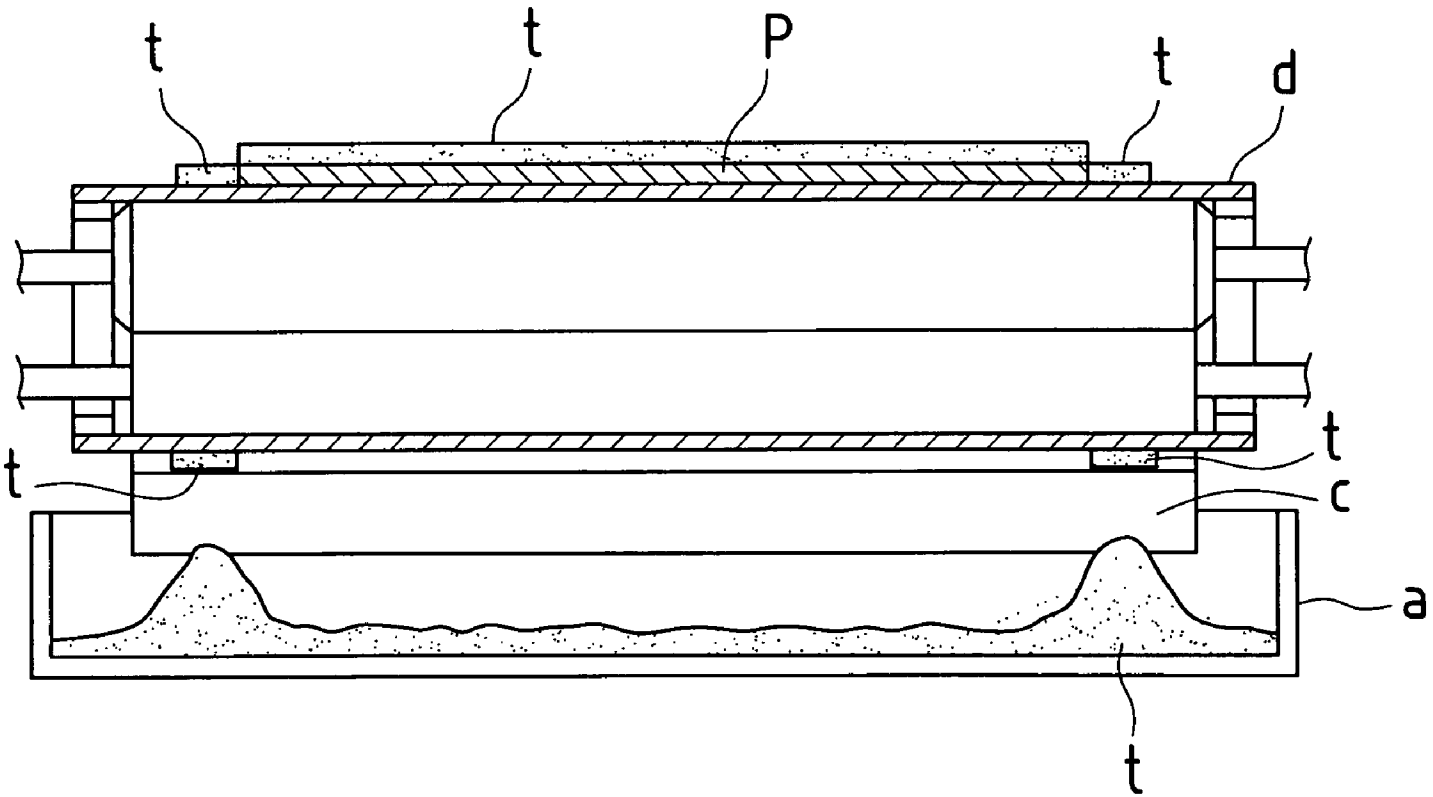
FIG.18 Prior Art
FIG. 18 is a cross-sectional view of a conventional cleaning device and a vicinity thereof, explaining how a toner is recovered.
Figure 19:
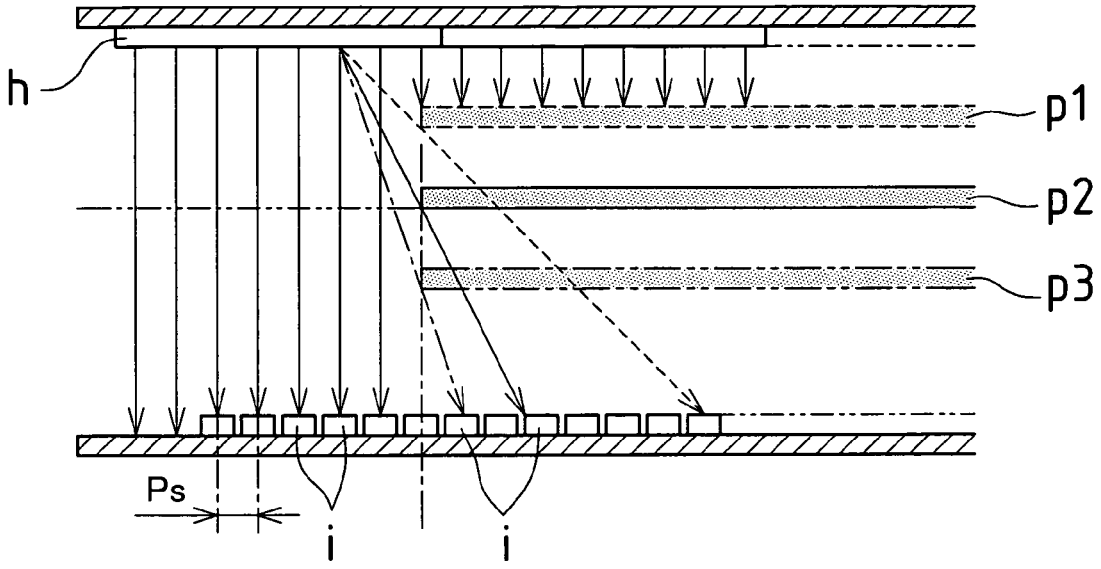
FIG.19 Prior Art
FIG. 19 is a diagram showing a conventional apparatus for detecting an edge position of a sheet.
Figure 20:
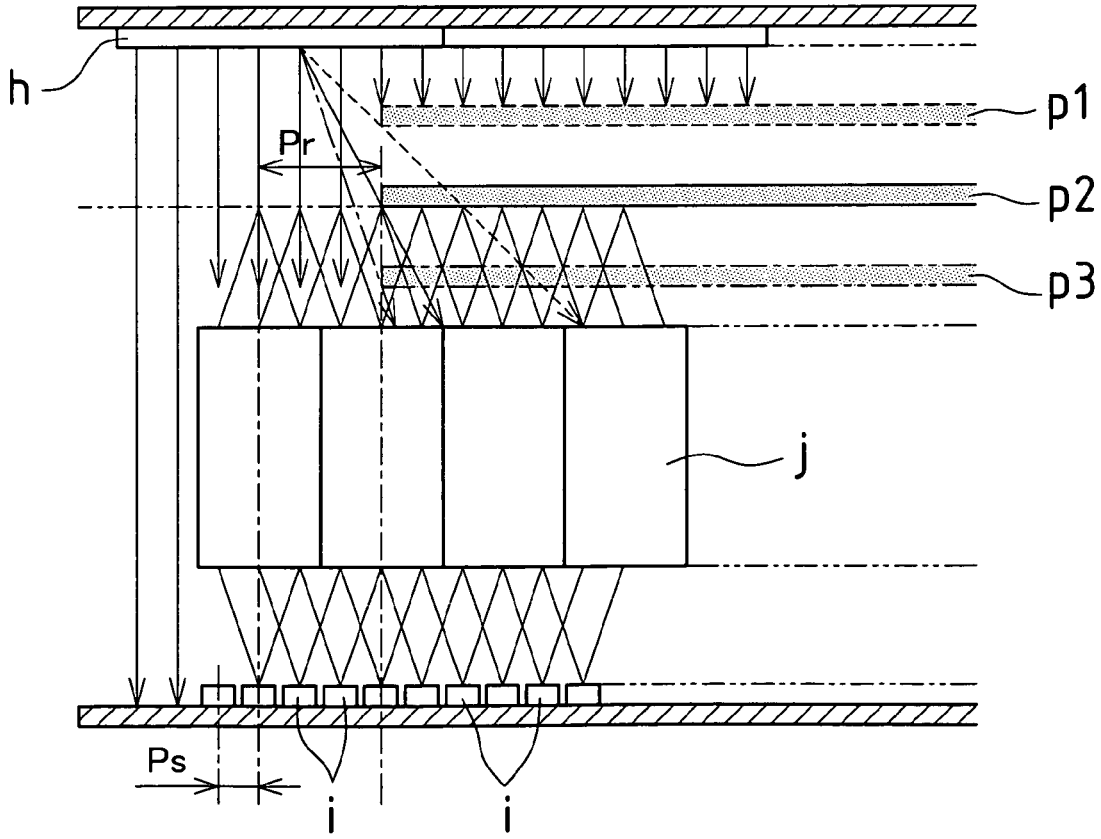
FIG.20 Prior Art
FIG. 20 is a diagram showing another conventional apparatus for detecting an edge position of a sheet.

As shown in FIG. 15, in the above-described image forming apparatus, a distance L1 from a registration point R of the registration rollers 10, 10 to a transfer point G is designed to be shorter than a distance L0 from a write point Q where an electrostatic latent image is written onto the photoconductive drum 3 by the laser write unit 81 to the above-described transfer point G. Note that reference numeral 40 indicates a control section in FIG. 14.

Therefore, in this example, the sheet detection registration sensor 51 is provided at the transport path merging site 76*c* located upstream, in the recording paper transport direction, from the registration roller 10, 10. The sheet detecting sensor 51 detects the edge position of the recording paper P when a predetermined time (e.g., 50 ms) has passed after the leading edge in the transport direction of the recording paper P abuts the registration rollers 10, 10. The predetermined time is a period of time which is required to adjust the position of the recording paper P by correcting the transport skew thereof after the leading edge in the transport direction of the recording paper P abuts the registration rollers 10, 10. Therefore, the edge position of the recording paper P, which is stopped with the transport skew thereof being corrected by the registration rollers 10, 10, is detected with very high accuracy. Furthermore, even when the position of the recording paper P varies vertically, the edge position of the recording paper can be accurately detected, resulting in a higher level of detection accuracy.

Based on the result of detection of the edge position of the recording paper P by the sheet detecting sensor 51, an image formation position in a main scanning direction perpendicular to the recording paper transport direction is set for an electrostatic latent image to be formed on the photoconductive drum 3 so that the image formation position matches the recording paper P. As a result, the quality of a formed image can be satisfactorily assured. Also, when no-margin image formation is performed, the image formation region in the main scanning direction perpendicular to the recording paper transport direction is set for an electrostatic latent image to be formed on the photoconductive drum 3, based on the result of detection of the edge position of the recording paper P when the predetermined time has passed after the leading edge in the transport direction of the recording paper P abuts the registration rollers 10, 10. The size of the oversized image for image formation can be reduced to the extent possible. Therefore, the amount of toner, which is not transferred to the recording paper P and is recovered, can be reduced to the extent possible. Thus, the amount of waste toner can be suppressed, resulting in economical toner consumption. In addition, a time required to fill a waste toner container with recovered toner can be elongated. Furthermore, in the cleaning device 7 integrated with a container for recovering toner, it is possible to suppress uneven accumulation of recovered toner, i.e., partial large accumulation of recovered toner, whereby imperfect cleaning due to partial leakage of the recovered toner can be avoided.

Moreover, as the sheet detecting sensor 51 is located upstream, in the recording paper transport direction, from the registration rollers 10, 10, the following procedure can be performed. The edge position of the recording paper P abutting the registration rollers 10, 10 is detected by the sheet detecting sensor 51. Thereafter, based on the result of detection of the edge position of the recording paper P, an image formation region is set for an electrostatic latent image to be formed the photoconductive drum 3. Transportation of the recording paper P is started by the registration rollers 10, 10 with appropriate timing for the formation of the electrostatic latent image on the photoconductive drum 3. Therefore, it is possible for the registration rollers 10, 10 to start transporting the recording paper P after the start of formation of an electrostatic latent image onto the photoconductive drum 3. In this case, the distance L1 from the transfer point G, where an image is transferred onto the recording paper P, to the registration point R of the registration rollers 10, 10, can be shorter than the distance L0 from the write point Q to the transfer point G. Furthermore, as the sheet detecting sensor 51 is located upstream, in the recording paper transport direction, from the registration rollers 10, 10, there are no longer constraints for a distance L2 from the transfer point G, where an image is transferred onto the recording paper P, to a detection point of the sheet detecting sensor 51. Thereby, a size of the image forming apparatus X can be reduced and a time required for image formation can be reduced.

Furthermore, a light receiving element 55 is provided for each opening portion 56*a* of the hood 56 so that only light emitted from immediately above the light receiving element 55 is guided down to the light receiving element 55. Therefore, even when the position of the recording paper P varies vertically, the edge position of the recording paper P can be accurately detected.

Note that the variations of FIGS. 10 to 12 can also be used as the sheet detecting sensor 51 of this example.

Other Examples

The present invention is not limited to the above-described examples, but includes other various variations. For example, although the first development device 5*a* of the first image forming station S1 contains a black toner, the second development device 5*b* of the second image forming station S2 contains a cyan toner, the third development device 5*c* of the third image forming station S3 contains a magenta toner, and the fourth development device 5*d* of the fourth image forming station S4 contains a yellow toner in Example 1, the present invention is not limited to this and the black toner, the cyan toner, the magenta toner, and the yellow toner may be contained in any arbitrary order in the development devices of the image forming stations.

Although the laser write unit 81 is used to write an electrostatic latent image onto the photoconductive drum 3 in Example 2, a solid-state scanning optical write head using an array of light emitting elements, such as an LED, an EL, or the like, may be used to write an electrostatic latent image.

Furthermore, although the integrated-type sheet detecting sensor 51 having a built-in illuminating means is used in the above-described examples, a separate-type sheet detecting sensor may be used, for which an illuminating means is placed at an opposite side with respect to a paper transport path, facing the sheet detecting sensor.

The present invention can be embodied and practiced in other different forms without departing from the spirit and essential characteristics thereof. Therefore, the above-described embodiments are considered in all respects as illustrative and not restrictive. The scope of the invention is indicated by the appended claims rather than by the foregoing description. All variations and modifications falling within the equivalency range of the appended claims are intended to be embraced therein.

What is claimed is:

1. A sheet detecting apparatus for use in an image forming apparatus, wherein the image forming apparatus forms an image on an image carrier based on input image data and transfers the image onto a transported sheet to form an image on the sheet, and the sheet detecting apparatus is used for detecting a transport state of the sheet before the image is transferred to the sheet, the sheet detecting apparatus comprising:

a linear light emitting section being a plurality of light sources are arranged in a line for irradiating a sheet transport path with light;

a plurality of light receiving sections for directly receiving the light from the linear light emitting section via the sheet transport path, wherein the plurality of light receiving sections are opposed to the linear light emitting section and arranged in a line along a direction perpendicular to a sheet transport direction; and a hood means for causing the light from the linear light emitting section to enter each light receiving section in a substantially straight direction via respective locations on the transport path, wherein the light emitted from each of the plurality of light sources is emitted in a direction perpendicular to the sheet transport direction and is directly incident on each of the plurality of light receiving sections, which are opposed to the liner light emitting section, via the sheet transport path, the hood means passes light from the liner light emitting section, only from immediately above each of the light receiving sections, into the corresponding light receiving sections, and the transported sheet passes in between the light emitting section and the plurality of light receiving sections.

2. The sheet detecting apparatus according to claim 1, wherein the hood means has a plurality of opening portions arranged in a line along the direction perpendicular to the sheet transport direction and guiding the light entering via the transport path from the light emitting section to the respective light receiving sections.

3. The sheet detecting apparatus according to claim 2, wherein the opening portions of the hood means absorb light with at least an inner wall surface thereof.

4. An image forming apparatus comprising:

a sheet detecting apparatus including a linear light emitting section being a plurality of light sources are arranged in a line for irradiating a sheet transport path with light, a plurality of light receiving sections for directly receiving the light from the linear light emitting section via the sheet transport path, wherein the plurality of light receiving sections are opposed to the linear light emitting section and arranged in a line along a direction perpendicular to a sheet transport direction, and a hood means for causing the light from the linear light emitting section to enter each light receiving section in a substantially straight direction via respective locations on the transport path, wherein the light emitted from each of the plurality of light sources is emitted in a direction perpendicular to the sheet transport direction and is directly incident on each of the plurality of light receiving sections, which are opposed to the linear light emitting section, via the sheet transport path, the hood means passes light from the linear light emitting section, only from immediately above each of the light receiving sections, into the corresponding light receiving sections, and the transported sheet passes in between the light emitting section and the plurality of light receiving sections;

registration means for correcting skew of the transported sheet; and image forming means for forming an image on the transported sheet, wherein the registration means is positioned upstream from the image formation means and includes a registration sensor for detecting a leading edge of the transported sheet, and the sheet detecting apparatus is positioned upstream from the registration means.

5. The image forming apparatus according to claim 4, wherein The sheet detecting apparatus is provided at a site where a plurality of transport paths for transporting the sheet are merged.

6. The image forming apparatus according to claim 4, wherein the hood means has a plurality of opening portions arranged in a line along the direction perpendicular to the sheet transport direction and guiding the light entering via the transport path from the light emitting section to the respective light receiving sections.

7. The image forming apparatus according to claim 4, wherein the opening portions of the hood means absorb light with at least an inner wall surface thereof.

* * * * *